US008388092B2

(12) United States Patent
Kaizu et al.

(10) Patent No.: US 8,388,092 B2
(45) Date of Patent: Mar. 5, 2013

(54) IMAGE FORMING APPARATUS AND IMAGE FORMING METHOD

(75) Inventors: Shunichi Kaizu, Kawasaki (JP); Hisashi Ishikawa, Urayasu (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/763,946

(22) Filed: Apr. 20, 2010

(65) Prior Publication Data

US 2010/0271414 A1 Oct. 28, 2010

(30) Foreign Application Priority Data

Apr. 27, 2009 (JP) ..... 2009-107998

(51) Int. Cl.
*B41J 29/38* (2006.01)

(52) U.S. Cl. ..... 347/16; 347/5

(58) Field of Classification Search ..... None
See application file for complete search history.

(56) References Cited

U.S. PATENT DOCUMENTS 6,874,864 B1 * 4/2005 Maeda et al. ..... 347/41
2002/0126192 A1 9/2002 Kawaguchi et al.

FOREIGN PATENT DOCUMENTS

JP 2002-254736 A 9/2002
JP 3376075 B2 2/2003

* cited by examiner

*Primary Examiner* — Geoffrey Mruk
(74) *Attorney, Agent, or Firm* — Canon U.S.A., Inc. IP Division

(57) ABSTRACT

An image forming apparatus includes a print head provided with a plurality of discharge ports, a scanning unit configured to cause the print head to scan the same printing region on a recording medium a number of times, a generation unit configured to generate image forming data for each of scans, based on image information that has been input, and an image forming unit configured to perform image forming by discharging inks from the discharge ports on the recording medium according to the image forming data generated by the generation unit. The generation unit includes a division unit configured to divide the image information, while controlling division coefficients, using each of the discharge ports as the reference based on the division coefficients, and a quantization unit configured to quantize each of image information divided by the division unit.

9 Claims, 20 Drawing Sheets

MAIN SCANNING DIRECTION
SUB-SCANNING DIRECTION
a b c d e f g h i j k l m
: FRACTION NOZZLE
REGION 1a 4-PASS
REGION 2a 3-PASS
REGION 3a 4-PASS

MAIN SCANNING DIRECTION
SUB-SCANNING DIRECTION
a b c d e f g h i j k l
: FRACTION NOZZLE
REGION 1b 4-PASS
REGION 2b 2-PASS
REGION 3b 4-PASS

MAIN SCANNING DIRECTION
SUB-SCANNING DIRECTION
a b c d e f g h i
: FRACTION NOZZLE
REGION 1c 3-PASS
REGION 2c 2-PASS
REGION 3c 3-PASS

IMAGE FORMING APPARATUS AND IMAGE FORMING METHOD

BACKGROUND OF THE INVENTION

1. Field of the Invention

The present invention relates to an image forming apparatus suitable for formation of color images and to an image forming method.

2. Description of the Related Art

An inkjet recording apparatus provided with a recording head including a plurality of ink discharge ports is known as an example of a recording apparatus provided with a recording head including a plurality of recording elements.

In the inkjet recording apparatus, size of dot formed by an ink and formation position vary according to variation of discharge amounts of the ink and variation of discharge directions of the ink (displacement), and uneven concentration may occur on printed images. Such uneven concentration due to variation of nozzle characteristics of the recording head appears in a form of streak-like unevenness (streak unevenness) on the printed images. Consequently, it is easily noticeable to human eyes, and quality of the printed images is deteriorated.

A technology for correcting such the uneven concentration is discussed. In this technology, when an image formation is performed using the inkjet recording head including a plurality of discharge ports, 1-line image data (dot pattern) is formed using a plurality of different nozzles. The technology can be realized by forming an image of the 1-line image data by a plurality of scan operations (scans or passes) which feed paper by an amount smaller than a width of the recording head, for example. The technology is generally termed a multipass printing or a multipass recording system. The multipass recording system includes a method using mask patterns.

Print data for respective passes are generated by performing AND operation of the mask patterns according to passes prepared in advance and generated print data (dot patterns). The mask patterns are created such that, assuming printable dots to be 100%, the printable dots are determined for respective passes exclusively between respective passes, and logical ORs of the printable dots by all passes constitute images equal to entire regions. The mask patterns themselves are designed to be random as far as possible in order to avoid an interference with half-tone processing.

On the other hand, if images are printed by the same pass number irrespective of concentration of images to be printed, it takes much printing time. To address this problem, a method for switching recording number of passes in the middle of recording one page is discussed (U.S. Pat. No. 3,376,075).

Furthermore, in an inkjet printer, there arises a problem that, when the recording medium passes through a nip position of roller pairs, conveyance error of the recording medium occurs, which brings about deterioration of image quality. Hereinbelow, an outline of the problem will be described using FIG. 16.

FIG. 16 A illustrates schematically a recording head and a recording medium, and a conveyance mechanism for conveying the recording medium while supporting it when the recording is being performed on the central part of the recording medium. As illustrated in FIG. 16A, a pinch roller 720 is arranged facing a conveyance roller 730, and a spur 740 is arranged facing a sheet discharge roller 750, so that two sets of nip portions exist. Then, the recording medium 710 is stretched taut, and supported by these nip portions. Further, the recording medium 710 is also supported by a platen 760.

Then, the recording medium 710 is conveyed in a direction indicated by an arrow in FIG. 16A along with rotation of two roller pairs (two sets of the nip portions).

Ahead cartridge 700 is arranged over the platen 760. In the head cartridge 700, a plurality of the recording elements (nozzles) for discharging the inks are arrayed at a predetermined pitch in the conveying direction in FIG. 16A. The head cartridge 700 discharges the inks from respective recording elements, while performing scanning in a backward direction of the drawing, and an image is formed on a region of the recording medium 710 positioned between the conveyance roller 730 and the sheet discharge roller 750. A recording scan by such the head cartridge 700, and a conveyance operation of the recording medium 710 by two roller pairs (2 sets of the nip portions) are alternately repeated, thereby forming images in sequence on the recording medium 710.

FIG. 16B schematically illustrates a state where the recording operation proceeds furthermore from the state in FIG. 16A, and the recording operation in proximity to the trailing edge of the recording medium 710 is being performed. As illustrated in FIG. 16B, when the trailing edge of the recording medium 710 is released from a clamping by the conveyance roller 730 and the pinch roller 720, the pinch roller 720 moves toward the conveyance roller 730 side by a thickness of the recording medium 710 that has been clamped until this moment. The recording medium 710 is eventually conveyed by extra amount, by an urging force of the pinch roller 720 as the recording medium comes out. Namely, when released from the clamping by the roller pairs, the recording medium 710 will be eventually conveyed by more amount than a predetermined amount that was defined in advance. Then, at this time, the conveyance roller 730 also rotates by an amount corresponding to the conveyance amount. Thus, the conveyance error of the recording medium 710 occurs, so there arises a problem that quality of the recorded image is deteriorated.

In order to cope with such the conveyance error, it is conceivable that, for example, a brake for suppressing the rotation of the conveyance roller is provided, so that an extra amount of conveyance of the recording medium be suppressed, when the recording medium comes out of the nip portions. However, in such a configuration, a loading torque for performing rotational drive of the conveyance roller becomes large, so there arise the detrimental effects that a sufficient conveying speed cannot be obtained if grade of a drive motor is not improved.

In order to solve such the problems, there is discussed a technology for determining nip positions at which the trailing edge passes through the roller pairs, according to change in rotational state of the rollers before and after the trailing edge of the recording medium passes through the nip positions of the roller pairs, and performing an image correction based on this nip position information (Japanese Patent Application Laid-Open No. 2002-254736).

Further, in the conveyance mechanism illustrated in FIG. 16, errors in the conveyance amount occur not only in the trailing edge of the recording medium 710, but also in the leading edge of the recording medium 710. In the technology discussed in Japanese Patent Application Laid-Open No. 2002-254736, although correction of the conveyance amount is performed in the trailing edge of the recording medium 710, correction of the conveyance amount is not performed in the leading edge of the recording medium. More specifically, in the conveyance mechanism as described above, in conveying the recording medium 710, the recording medium 710 may be conveyed less than an intended predetermined conveyance amount, when shifting to a state where the leading edge thereof is clamped by the sheet discharge roller 750 and the spur 740. Then, a relative position of the recording head with respect to the recording medium 710 may be thereby deviated from the intended position. As a result, position (image position) of ink dots discharged from the recording head and formed on the recording medium 710 is deviated, so that quality of the recorded image may be impaired.

Furthermore, in the technology discussed in Japanese Patent Application Laid-Open No. 2002-254736, if rotations of the conveyance rollers are not constant, it may be difficult to exactly detect positions of the nip portions, so that it may be difficult to obtain high image quality with stability.

SUMMARY OF THE INVENTION

According to an aspect of the invention, an image forming apparatus includes a print head provided with a plurality of discharge ports, a scanning unit configured to cause the print head to scans the same printing region on a recording medium a number of times, a generation unit configured to generate image forming data for each of scans, based on image information that has been input, and an image forming unit configured to perform image forming by discharging inks from the discharge ports onto the recording medium according to the image forming data generated by the generation unit, wherein the generation unit includes a division unit configured to divide the image information, while controlling division coefficients, using each of the discharge ports as the reference based on the division coefficients, and a quantization unit configured to quantize each of image information divided by the division unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
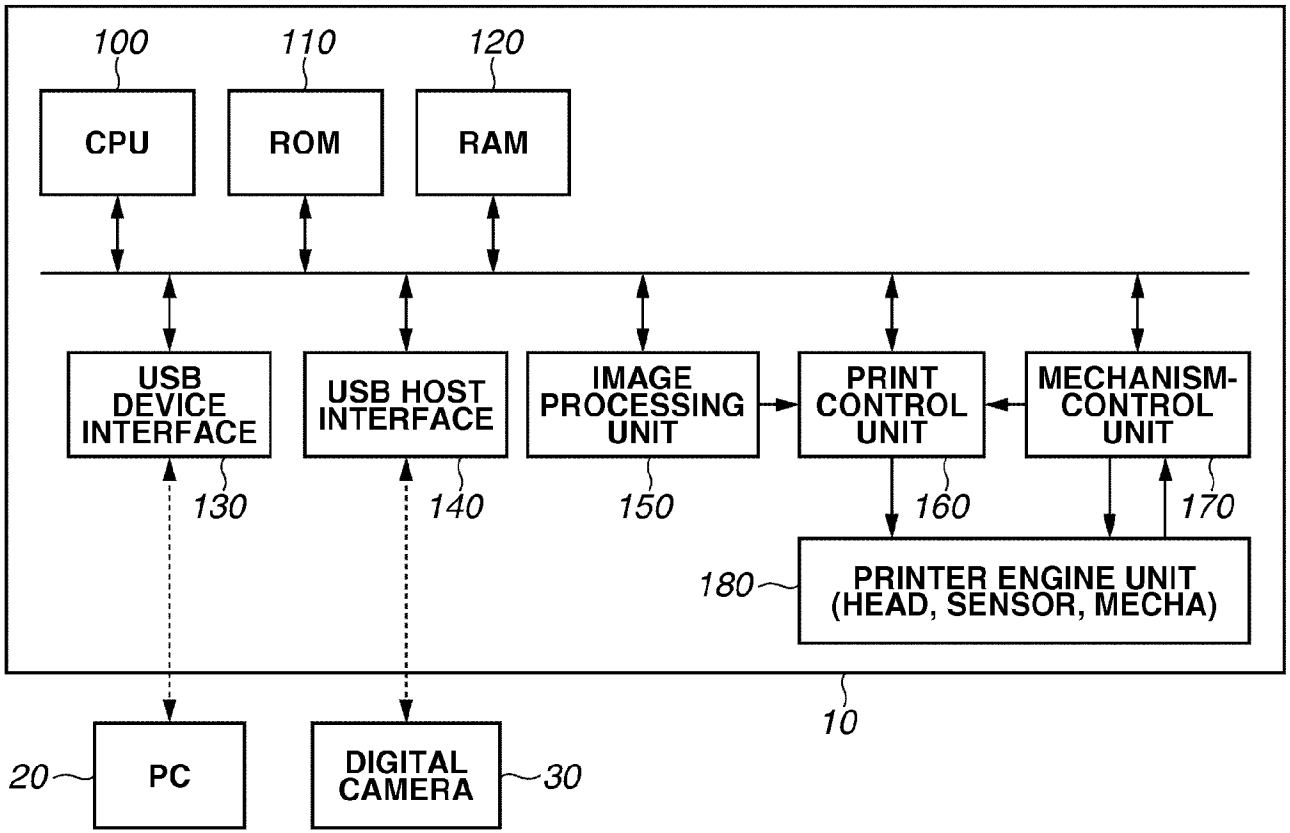
FIG. 1 is a block diagram illustrating a configuration of an inkjet printer according to a first exemplary embodiment.

Firstly, a first exemplary embodiment will be described below. FIG. 1 is a block diagram illustrating a configuration of an inkjet printer according to the first exemplary embodiment.

As illustrated in FIG. 1, an inkjet printer 10 according to the first exemplary embodiment includes a central processing unit (CPU) 100, a read-only memory (ROM) 110, a random-access memory (RAM) 120, a universal service bus (USB) device interface 130, and a USB host interface 140. Further, the inkjet printer 10 also includes an image processing unit 150, a print control unit 160, a mechanism-control unit 170, and a printer engine unit 180. In the ROM 110, a program and table data that the CPU 100 executes are stored. The RAM 120 stores variables and data. The USB device interface 130 receives data from an external personal computer (PC) 20. The USB host interface 140 receives data from an external digital camera 30 or the like.

The image processing unit 150 performs color conversion and binarization processing of multi-value image input from the digital camera 30 or the like. The print control unit 160 sends print data (image forming data) that has undergone binarization processing by the image processing unit 150 to print heads to perform print control. The mechanism-control unit 170 controls a paper feeding mechanism and a carriage feeding mechanism for performing printing. In the printer engine unit 180, there are provided heads for performing printing, a sensor for detecting a printing state, and a conveyance mechanism of the recording medium and a conveyance mechanism of the carriage. If the inkjet printer 10 is a line head printer, the conveyance mechanism of the carriage is not needed.

Next, an outline of an operation of the inkjet printer 10 will be described below. An operation of feeding an image captured by the digital camera 30 directly to the inkjet printer 10 to print it will be herein described.

Firstly, a type of the recording medium on which image data is printed is detected. A recording medium sensor (not shown) for detecting a type of the recording medium (not shown) set up on the printer engine unit 180 reads out information of the recording medium, and the CPU 100 discriminates the type of the recording medium. A configuration of the sensor for detecting the type of the recording medium is not particularly limited. For example, the sensor is configured to project a light with a specific wavelength and read out the reflected light.

Image data captured by the digital camera 30 is stored in a memory (not shown) within the digital camera 30 as a Joint Photographic Experts Group (JPEG) image, for example. The digital camera 30 is connected to the USB host interface 140 via a connection cable. The image data stored in the memory of the digital camera 30 is temporarily stored in the RAM 120 via the USB host interface 140. Since the received image data from the digital camera 30 is the JPEG image, the CPU 100 decompresses compressed image to obtain image data, and stores them in the RAM 120. Print data is generated to print the image using print heads within the printer engine unit 180, based on the image data.

More specifically, the image processing unit 150 performs color conversion, concentration division (pass division) and binarization processing on the image data stored in the RAM 120, and converts them into print data (dots data) for printing. The details of contents of the conversion will be described below. The print data that has undergone pass division is sent to the print control unit 160, and is sent to a printhead of the printer engine unit 180 in driving order of the printhead. Then, in synchronism with the mechanism-control unit 170 that controls a motor and mechanism-portion of the printer engine unit 180, and the printer engine unit 180 controlled by the mechanism-control unit 170, the print control unit 160 generates discharge pulse, and discharges ink droplets, thereby an image is formed on the recording medium (not shown).

In the foregoing description, while the image processing unit 150 is to perform binarization processing, not only binarization but also quantization processing is feasible. For example, N-value conversion (N is an integer equal to 2 or more) processing for generating print data for printing using dark and light ink, printing using large/small or large/medium/small liquid droplets of ink liquid droplets is also allowed.

Further, instead of performing discrimination of a type of the recording medium, a user may select a type of the recording medium.

Figure 2A:
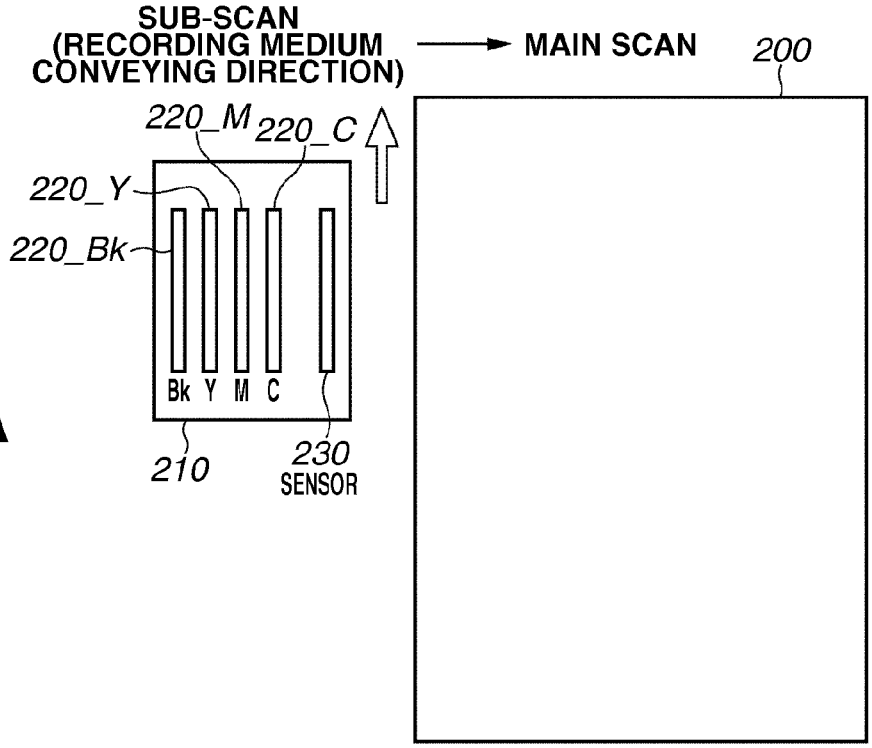
FIGS. 2A, 2B and 2C illustrate a relationship among an inkjet head, a sensor and a print medium in the first exemplary embodiment.

Next, a relationship among an inkjet head, a sensor and a print medium in the first exemplary embodiment will be described below. FIG. 2A illustrates a relationship among the inkjet head, the sensor and the print medium in the first exemplary embodiment.

An inkjet head 220_C having a plurality of nozzles (discharge ports) for cyan, an inkjet head 220_M having a plurality of nozzles for magenta, an inkjet head 220_Y having a plurality of nozzles for yellow are mounted on a carriage 210. Furthermore, an inkjet head 220_BK having a plurality of nozzles for black, and a sensor 230 for detecting the printing state on the recording medium (print medium) 200 are also mounted on the carriage 210. The sensor 230 is provided within the printer engine unit 180.

The carriage 210 performs scanning in a main scanning direction (thin arrow from left to right) on the recording medium 200 and discharges ink droplets from discharge nozzle of each inkjet head 220_*x* (x is C, M, Y or BK) during the scanning operation, to perform printing. When printing in one main scan is completed, the recording medium 200 is conveyed in a sub-scanning direction (bold arrow from bottom to top), the recording medium 200 is set up at a position for the next main scan.

In the present exemplary embodiment, in order to perform multipass printing that performs printing by a plural number of times of scans on the same printing region, a conveyance amount of the recording medium 200 per one cycle is smaller than a nozzle width of the inkjet head 220_*x*. For example, when the 4-pass printing is performed, the conveyance amount per one cycle is ¼ of the nozzle width of the inkjet head 220_*x*. In the present exemplary embodiment, the sensor 230 is positioned at upstream side of the inkjet head 220_*x* with respect to the main scanning direction.

In this way, since the sensor 230 is arranged at the upstream side, a printing state up to previous passes (scans) in the multipass printing can be detected. The printing state is influenced by variation of the conveyance amounts of the recording medium 200 resulting from discharge characteristics of the inkjet head and printer mechanism. The discharge characteristics include variation of amounts of ink discharges and variation of ink discharge directions. The image processing unit 150 controls generation of print data by the inkjet head 220_*x* according to printing state detected by the sensor 230. The details will be described below.

In the present exemplary embodiment, the sensor uses a RGB color sensor. The sensor may also use different configuration such as a complementary color sensor of CMY or a monochrome sensor.

Figure 2B:
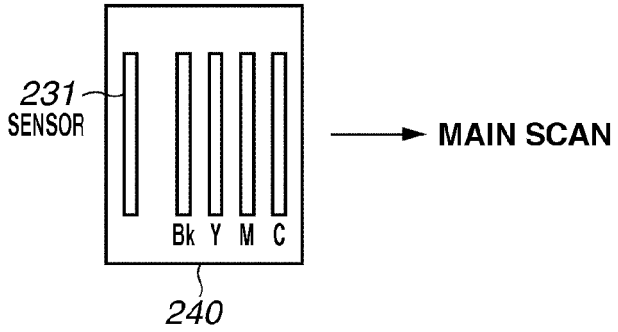

Alternatively, a carriage 240 in which a sensor 231 is arranged at downstream side of the inkjet head 220_*x*, as illustrated in FIG. 2B may be used, as substitute for the carriage 210. If the sensor 231 is arranged at the downstream side, a state immediately after printing by the inkjet head 220_*x* can be detected. Thereby, though a next variation of the conveyance amount of the recording medium 200 cannot be detected, discharge characteristics of the inkjet head can be detected.

Figure 2C:
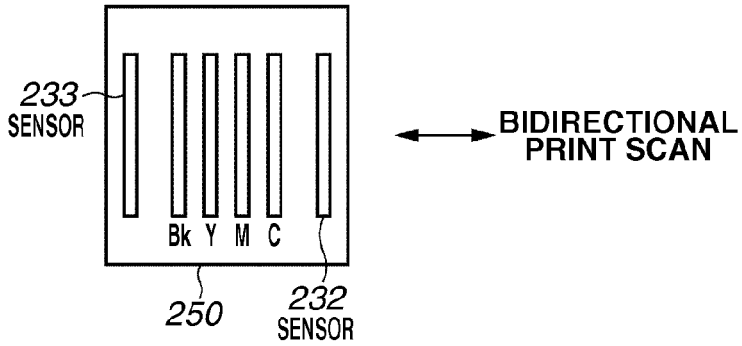

Further, the carriage 250 in which two sets of the sensors 232 and 233 are arranged, as illustrated in FIG. 2C may be used as substitute for the carriage 210. The sensor 232 is arranged at the upstream side of the inkjet head 220_*x*, when the carriage 250 is scanned in a right direction, and the sensor 233 is arranged at the upstream side of the inkjet head 220_*x* when the carriage 250 is scanned in a left direction. With such a configuration, when printing is performed by causing the carriage 250 to scan in a two-way, similar control can be performed in either case of right direction printing, and left direction printing by switching between the sensor 232 and the sensor 233.

Figure 3:
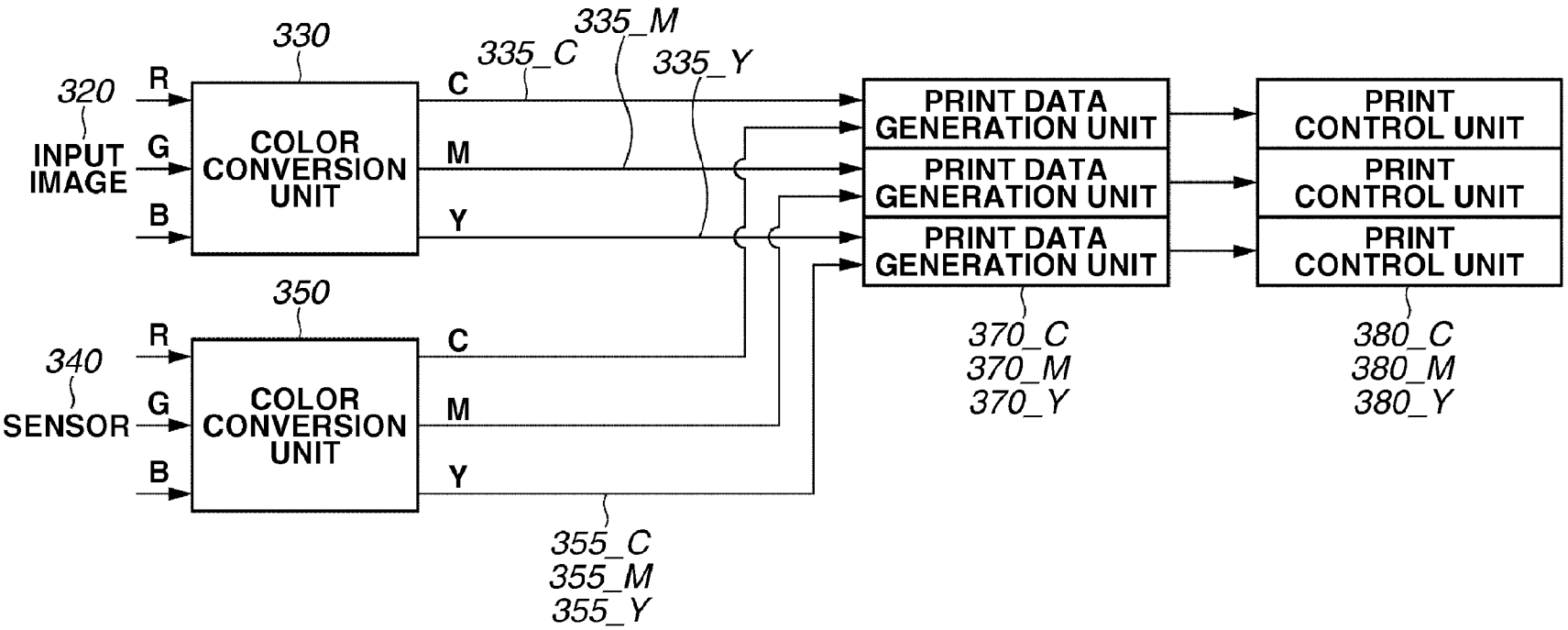
FIG. 3 is a block diagram illustrating a configuration of an image processing unit and a print control unit.

FIG. 3 is a block diagram illustrating a configuration of the image processing unit 150 and the print control unit 160. The image processing unit 150 generates print data according to input image and a detection signal by the sensor.

As illustrated in FIG. 3, the image processing unit 150 includes color conversion units 330 and 350, a print data generation unit 370_C for cyan, a print data generation unit 370_M for magenta, and a print data generation unit 370_Y for yellow.

The color conversion unit 330 converts RGB of input image information 320 into CMY (a signal 335_C for cyan, a signal 335_M for magenta, and a signal 335_Y for yellow). The color conversion unit 350 converts RGB signals detected by the sensor 340 for detecting a printing state into CMY (a signal 335_C for cyan, a signal 335_M for magenta, and a signal 335_Y for yellow). The color conversion unit 350 performs color conversion in view of color filter characteristics of RGB of the sensor 340, characteristics of light source that is given to a detection region of the sensor 340, and characteristics of the inks.

Print data generation units 370_CMY quantize signals 335_CMY for cyan according to detection signals 355_CMY for cyan, and generates print data.

The print control unit 160 includes a print control unit 380_C for cyan, a print control unit 380_M for magenta, and a print control unit 380_Y for yellow, and controls printing that uses the printer head according to print data generated by the print data generation unit.

Next, an operation of the print data generation unit 370_*x* in FIG. 3 will be described in detail, while referring to FIG. 4. In this process, the 4-pass print is taken as an example, but the operation regarding the multipass printing other than the 4-pass print is also similar thereto.

The print data generation unit 370_*x* includes a line counting unit 470, a print pass number determination unit 480 and a paper feeding amount control unit 490. The line counting unit 470 manages a position from a front-end of the printhead of a current line. The print pass number determination unit 480 determines a number of print passes (number of times of scans) of the current line. The paper feeding amount control unit 490 controls a paper feeding amount depending on the number of print passes determined by the print pass number determination unit 480. Further, a pass division table 410 stores division coefficients for the purpose of the pass division, outputs the division coefficients (a pass division coefficient 415_1 (k1) of a first pass, a pass division coefficient 415_2 (k2) of a second pass, a pass division coefficient 415_3 (k3) of a third pass and a pass division coefficient 415_4 (k4) of a fourth pass) depending on the print pass number determined by the print pass number determination unit 480.

The pass division coefficient 415 is a coefficient for determining a print concentration of each pass when the 4-pass printing is performed, and the pass division coefficients k1, k2, k3, k4 represent division ratios of the first pass, the second pass, the third pass, the fourth pass, respectively. The pass division coefficients satisfy, $$0<=ki<=1(i:1, 2, 3, 4)$$

$$k1+k2+k3+k4=1.$$

For example, k1, k2, k3, and k4 each are set to a value of 0.25. Further, for example, values with decreased print ratios of a first pass and increased print ratios of subsequent passes (k1, k2, k3, and k4 are values of 0.1, 0.2, 0.3, and 0.4, respectively) are set up. The pass division with arbitrary concentration ratios can be performed by controlling the pass division coefficients. If concentration of printing is intentionally adjusted, there are some cases where a total sum of number of pass divisions is no longer "1".

A multiplier 420_1 calculates a print concentration of the first pass by multiplying a print image signal 400 (a signal corresponding to 335_*x* in FIG. 3) output from the color conversion unit 330 by the pass division coefficient k1(415_1) of the first pass. A multiplier 420_2 calculates a print concentration of the second pass by multiplying the print image signal 400 by the pass division coefficient k2 (415_2) of the second pass. A multiplier 420_3 calculates the print concentration of the third pass by multiplying the print image signal 400 by the pass division coefficient k3(415_3) of the third pass. A multiplier 420_4 calculates a print concentration of the fourth pass by multiplying the print image signal 400 by a pass division coefficient k4 (415_4) of the fourth pass. A pass division coefficient of each pass is equivalent to a print concentration ratio of each pass.

The print data generation unit 370_*x* is provided with the print data control unit 440 that generates control data for print data generation, according to signal 430 (a signal corresponding to 355_*x* in FIG. 3) from the color conversion unit 350.

A quantization unit 450_1 performs quantization processing on outputs of the multiplier 420_1, to generate print data of the first pass. A quantization unit 450_2 performs quantization processing on outputs of the multiplier 420_2, to generate print data of the second pass responsive to a control signal from the print data control unit 440. A quantization unit 450_3 performs quantization processing on outputs of the multiplier 420_3 responsive to the control signal from the print data control unit 440 to generate print data of the third pass. A quantization unit 450_4 performs quantization processing on outputs of the multiplier 420_4 responsive to the control signal from the print data control unit 440 to generate print data of the fourth pass.

A first pass recording image storage unit 460_1, a second pass recording image storage unit 460_2, a third pass recording image storage unit 460_3, and a fourth pass recording image storage unit 460_4, record the print data generated by the quantization units 450_1 through 4.

Next, generation of the print data for each pass will be described below.

Firstly, generation of the print data with respect to a region of the first pass will be described below. Firstly, the print image signal 400 for each of ink colors resolved into the respective ink colors to be printed by the color conversion unit 330 is multiplied by the pass division coefficient k1 from the pass division table 410 by the multiplier 420_1, thereby determining a print concentration of the first pass. The print concentration of the first pass is quantized by the quantization unit 450_1 for the first pass to generate the print data. The generated print data of the first pass is stored in the first pass recording image storage unit 460_1 as a first pass recorded image.

Next, generation of the print data with respect to a region of the second pass will be described below. Firstly, the print image signal 400 for each of the ink colors is multiplied by the pass division coefficient k2 from the pass division table 410 by the multiplier 420_2, thereby determining a print concentration of the second pass. Also, when the print data of the second pass is generated, a signal indicating the printing state of the first pass detected by the sensor 340 is converted into CMY by the color conversion unit 350, and the print data control unit 440 generates control data according to the signal 430.

The control data includes data for correction of concentration level, and data for quantization. Then, a print concentration of the second pass is quantized by the quantization unit 450_2 for the second pass according to the control data. More specifically, in the present exemplary embodiment, a state of a printing (printing of the first pass) by previous carriage scanning in the multipass printing is detected by the sensor 340, and generation of print data (e.g., dots generation, dots arrangement) by the quantization unit 450_2 is controlled based on the result. Then, the generated print data of the second pass is stored in the second pass recording image storage unit 460_2 as a second pass recorded image.

Generation of print data with respect to regions of the third pass and the fourth pass is similar to generation of print data with respect to a region of the second pass.

Figure 4:
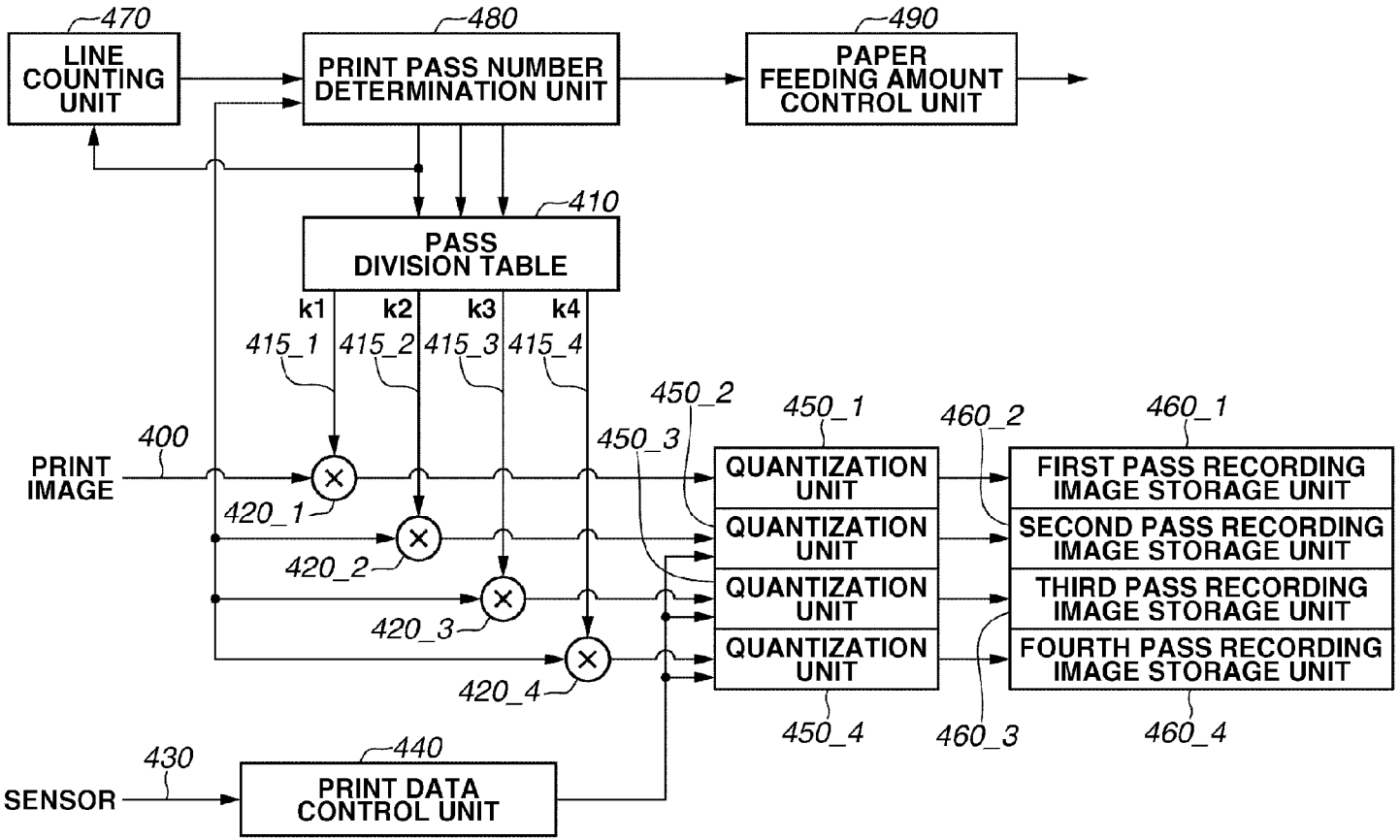
FIG. 4 is a block diagram illustrating a configuration of a print data generation unit in the first exemplary embodiment.

If the 3-pass printing is performed in the configuration in FIG. 4, the pass division coefficients k1, k2, and k3 represent division ratios of the first pass, the second pass, and the third pass, respectively. Each pass division coefficient meets respectively, $$0<=ki<=1(i:1, 2, 3)$$

$$k1+k2+k3=1.$$

Further, if the 2-pass printing is performed, pass division coefficients k1, k2 represent division ratios of the first pass, the second pass, respectively. Each pass division coefficient satisfies respectively, $$0<=ki<=1(i:1, 2)$$

$$k1+k2=1.$$

Further, pass division coefficients (print ratios) of respective passes are arbitrarily divisible within the condition of the above-described equation, similarly to the 4-pass printing.

Further, if the 3-pass printing is performed, the quantization unit 450_4 and the fourth pass recording image storage unit 460_4 are not used. Similarly, if the 2-pass printing is performed, the quantization unit 450_3, the quantization unit 450_4, the third pass recording image storage unit 460_3 and the fourth pass recording image storage unit 460_4 are not used.

A number of print passes is determined by the print pass number determination unit 480. In the present exemplary embodiment, the print pass number determination unit 480 referring to the print image signal 400, causes the number of print passes to decrease since uneven concentration is less noticeable, for example, in a region where generation density of dots is higher than a predetermined density and in a region where the generation density of dots is lower than another predetermined density. As the result, printing is performed at a high speed.

The region where the generation density of dots is higher than the predetermined density and the region where the generation density of dots is lower than another predetermined density corresponds to a region of a high concentration, and a region of a low concentration, respectively. On the other hand, the print pass number determination unit 480 causes the number of print passes to increase in a flat portion of a halftone region where the uneven concentration is noticeable, to achieve an higher image-quality of print. The details of a method for determining a pass number will be described below.

Figure 5:
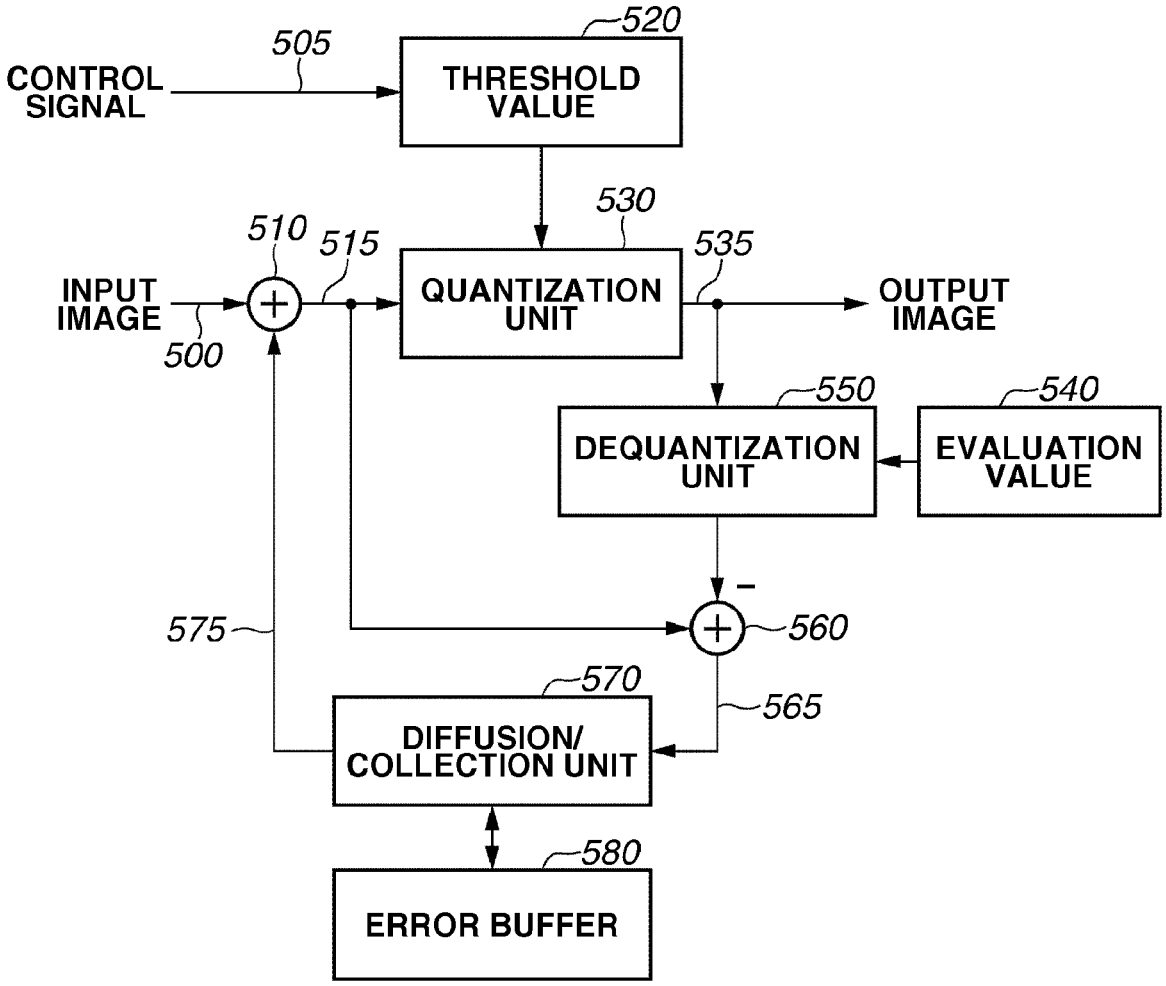
FIG. 5 is a block diagram illustrating a configuration of a quantization unit.

Next, quantization using an error diffusion as an example of processing of the quantization unit 450_*x* in FIG. 4 will be described, while referring to FIG. 5. FIG. 5 is a block diagram illustrating a configuration of the quantization unit 450_*x*.

An adder 510 adds an error diffused from peripheral pixels to an input image signal (a signal equivalent to an output of the multiplier 420_*x*) 500 for quantizing. A threshold value generation unit 520 generates a threshold value of quantization processing, according to a control signal 505 (a signal equivalent to an output of the print data control unit 440). The quantization unit 530 performs quantization on an image signal 515 to which the error has been added using the threshold value generated by the threshold value generation unit 520. A dequantization unit 550 performs dequantization on an output signal 535 of the quantization unit 530, using a predetermined evaluation value 540.

The adder 560 calculates a difference between the image signal 515 and the result of dequantization. In other words, the adder 560 calculates quantization error occurred in quantization processing of a target pixel. A diffusion/collection unit 570 stores a quantization error signal 565 in an error buffer 580. Then, the adder 560 calculates an error with respect to the input image signal, from the quantization error of peripheral pixels of the input image signal, and error diffusion coefficient.

Control data generated by the print data control unit 440 according to a detection signal indicating a printing state detected by the sensor 340 is input into the threshold value generation unit 520 as a control signal 505 to the threshold value generation unit 520. Hence, the threshold value of the quantization processing will fluctuate, depending on the printing state detected by the sensor 340. In the present exemplary embodiment, the threshold value of the quantization processing is controlled so that a position of newly generated dots relative to a dot position already printed be generated in a separate position, in other words, finally printed dots be dispersed.

The threshold value of the quantization processing is set to be high with respect to a region where dots are already generated (namely, a region where concentration is high), so that dots cannot be easily generated. On the other hand, with respect to a position where dots are not generated (namely, a region where concentration is low), the threshold value of the quantization processing is set to be low, so that dots can be easily generated. Through such a control of the threshold value, dispersibility of dots between passes in the multipass printing can be enhanced. Since the quantization processing is performed by an error diffusion method on print concentrations for respective passes determined by the pass division coefficients k1 through k4, using the threshold value that has been set up depending on the printing state until a previous scan, dot generation positions can be controlled without changing dot generation ratios.

Since dots have not been printed before the first pass, regarding a print data generation of the first pass of the quantization unit 450_*x*, the control signal 505 is not input. Regarding the first pass, the threshold value generation unit 520 performs quantization processing using the threshold values which are fixed, or the threshold values which fluctuate depending on input concentrations for correcting texture or dot generation delay.

Further, the quantization processing by the quantization unit 450_*x* is not limited to the error diffusion processing, but it is also possible to control the print data generation by performing processing using, for example, a dither matrix. However, since a feedback loop does not exist, in a dithering method, in order to cancel concentration fluctuations by the above-described threshold value control, it is necessary to superpose fluctuation amounts of the threshold values on fluctuation amounts in which positive and negative signs are opposite on neighboring pixels.

Next, a flow of data processing that has been described while referring to FIG. 3, FIG. 4, and FIG. 5 will be described in conjunction with a region on the recording medium and a scan of the carriage while referring to FIG. 6.

Figure 6A:
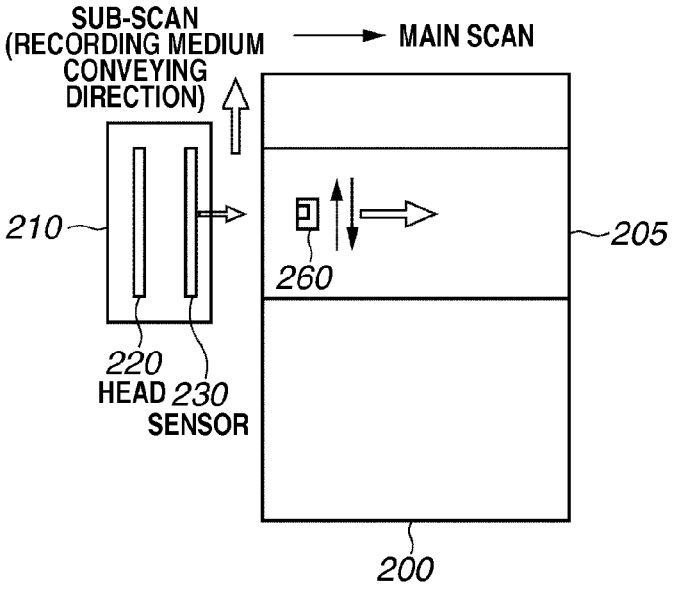
FIGS. 6A and 6B illustrate scan and data processing in the first exemplary embodiment.
Figure 6B:
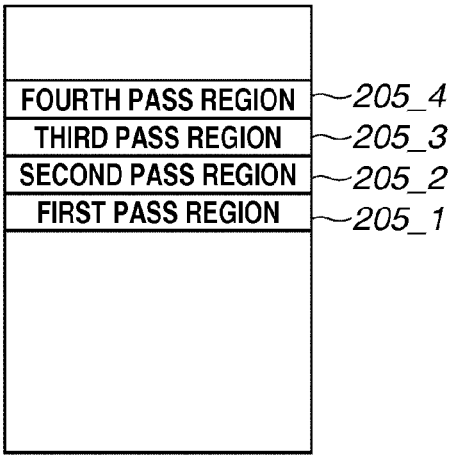

As illustrated in FIG. 6A, the carriage 210 moves in the main scanning direction (from left to right direction in FIG. 6A) on the recording medium 200. Then, an image is formed on the recording medium 200 using the inkjet head 220, which is an aggregate of the inkjet head 220_*x*. The sensor 230 is a line sensor having a width, for example, equal to a nozzle width of the inkjet head 220, or equal to a width except for a nozzle region of the first pass print. Further, the sensor 230 is arranged, similarly to the example illustrated in FIG. 2A, at an upstream position that is ahead of the inkjet head 220 relative to the main scanning direction of the carriage 210, and detects a printing state on the recording medium 200 printed by the previous scan following the main scan of the carriage 210.

Since the sensor 230 is a line sensor, the printing state detected by the sensor 230 is read out in a line direction on the sensor 230. Further concurrently, an input image signal stored in the RAM 120 is read out in a row direction (vertical direction in FIG. 6A) relative to the printing region 205. Then, the image processing unit 150 generates print data from the input image signal, based on the printing state detected by the sensor 230. The generated print data is stored, temporarily, in the RAM 120. Therefore, it is preferable to preset a capacity of the RAM 120 for storing the print data depending on a distance from the sensor 230 to the inkjet head 220. If the sensor 230 is arranged just in front of the inkjet head 220, the RAM 120 requires less capacity. However, owing to constructions of the sensor 230, the inkjet head 220 and the carriage 210, there is some restriction on a location where the sensor 230 and the inkjet head 220 can be arranged. For this reason, it is preferable to set the capacity of the RAM 120 in dependence on positional relationship of these components.

The print data is generated along a vertical direction of a printing region 205. Consequently, generation of the print data is performed while traversing longitudinally in the vertical direction a region 205_1 of the first pass, a region 205_2 of the second pass, a region 205_3 of the third pass, and a region 205_4 of the fourth pass, illustrated in FIG. 6B, out of the printing region 205 by the sub-scan.

It is also conceivable to change a number of print passes in the middle of the recording operation of a page. However, when such a control is performed, idle nozzles eventually appear that are not used for printing during the change of the number of print passes. Now, an idle nozzle will be described while referring to FIGS. 7A through 7C.

Figures 7A, 7B, 7C:
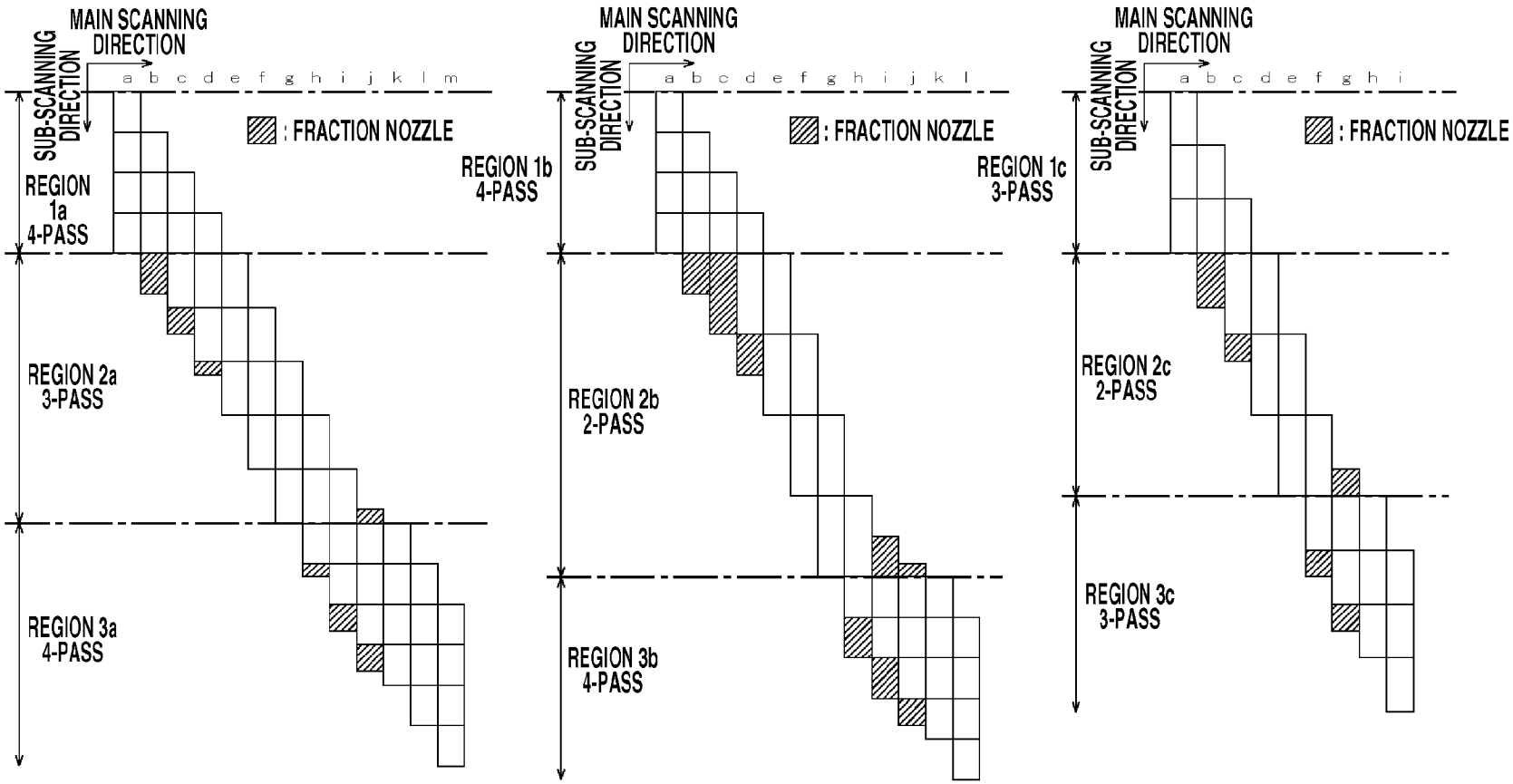
FIGS. 7A, 7B and 7C illustrate idle nozzles when a pass number is switched.

FIG. 7A illustrates idle nozzles in the case where a pass number is switched from the 4-pass to the 3-pass, after that, the pass number is switched from the 3-pass to the 4-pass. Descriptions will be herein given based on 13 states, i.e., a state "a" through a state "m" of the inkjet head and the recording medium that undergo a transition in succession. It is assumed that a region 1*a* of the recording medium is a target of the 4-pass print, a region 2*a* is a target of the 3-pass print, and a region 3*a* is a target of the 4-pass print.

Firstly, in the state "a", printing of images is performed by causing the inkjet head to move in the main scanning direction at a position of the sub-scanning direction that falls within the region 1*a*.

When the printing of the region 1*a* is completed, the recording medium is conveyed in the sub-scanning direction by ¼ of a head width of the inkjet head (width in the sub-scanning direction), and undergoes a transition from the state "a" to a state "b". The operation is equivalent to, if the recording medium is used as the base, movement of the inkjet head in a from-top-to-bottom direction in FIG. 7A (sub-scanning direction). Thus, in FIG. 7A, a moving direction of the inkjet head is assumed to be in the from-top-to-bottom direction in the drawing.

When scanning and printing operations in the main scanning direction are performed in the state "b", the recording medium is conveyed again in the sub-scanning direction by ¼ of the head width, and undergoes a transition to a state "c".

After that, printing and conveyance of the recording medium are repeated, until printing is performed up to a state "m".

A conveyance amount of the recording medium is dependent on the number of print passes. A conveyance amount from the state "a" to a state "d" is ¼ of the head width, a conveyance amount from a state "e" to a state "h" is ⅓ of the head width, and a conveyance amount of a state "i" is ¼ of the head width. A conveyance amount of a state "j" is 1/12 of the head width, and a conveyance amount from a state "k" to a state "l" is ¼ of the head width.

The state "b", the state "c" and the state "d" correspond to a transition period during which switching is performed from the 4-pass print to the 3-pass print. Then, in the transition period of the pass number, the conveyance amount of the recording medium is changed, along with change of recorded pass number, idle nozzles appear that are not used for printing. In FIG. 7A through FIG. 7C, the diagonally shaded regions are regions corresponding to the idle nozzles.

Further, the state "h", the state "i" and the state "j" correspond to a transition period during which switching is performed from the 3-pass print to the 4-pass print. Then, the idle nozzles appear even in these states.

FIG. 7B illustrates idle nozzles in the case where the pass number is switched from the 4-pass to the 2-pass, and after that, the pass number is switched from the 2-pass to the 4-pass. Descriptions will be herein given, based on 12 states from the state "a" to the state "l" of the inkjet head and the recording medium that undergoes a transition in succession. A region 1*b* of the recording medium is a target of the 4-pass print, a region 2*b* is a target of the 2-pass print, and a region 3*b* is a target of the 4-pass print.

A conveyance amount from the state "a" to the state "d" is ¼ of the head width, a conveyance amount from the state "e" to the state "g" is ½ of the head width, and a conveyance amount of the state "h" is ¼ of the head width. A conveyance amount of the state "i" is ⅙ of the head width, a conveyance amount of the state "j" is 1/12 of the head width, and a conveyance amount of the state "k" is ¼ of the head width.

In the case of FIG. 7B, the state "b", the state "c", and the state "d" correspond to a transition period during which switching is performed from the 4-pass print to the 2-pass print. Then, idle nozzles appear even in these states.

Also, the state "h", the state "i", and the state "j" correspond to a transition period during which switching is performed from the 2-pass print to the 4-pass print. Then, idle nozzles appear even in these states.

FIG. 7C illustrates idle nozzles in the case where the pass number is switched from the 3-pass to the 2-pass, and after that, the pass number is switched from the 2-pass to the 3-pass. A region 1*c* is a target of the 3-pass print, a region 2C is a target of the 2-pass print, and a region 3C is a target of the 3-pass print.

A conveyance amount from the state "a" to the state "c" is ⅓ of the head width, a conveyance amount from the state "d" to the state "e" is ½ of the head width, a conveyance amount of the state "f" is ⅓ of the head width. Also, a conveyance amount of the state "g" is ⅙ of the head width, and conveyance amount of the state "h" is ⅓ of the head width.

If such a printing is performed, the state "b" and the state "c" correspond to a transition period during which switching is performed from the 3-pass print to the 2-pass print. Then, idle nozzles appear even in these states.

Further, the state "f" and the state "g" correspond to a transition period during which switching is performed from the 2-pass print to the 3-pass print. Then, idle nozzles appear even in these states.

In this way, when the recording medium is conveyed even in a transition period of the pass number, printing is performed by a plurality of different nozzles on the same region in the recording medium. Consequently, the effects inherent to the multipass printing can be obtained. However, as described above, idle nozzles will eventually appear.

Figure 8A:
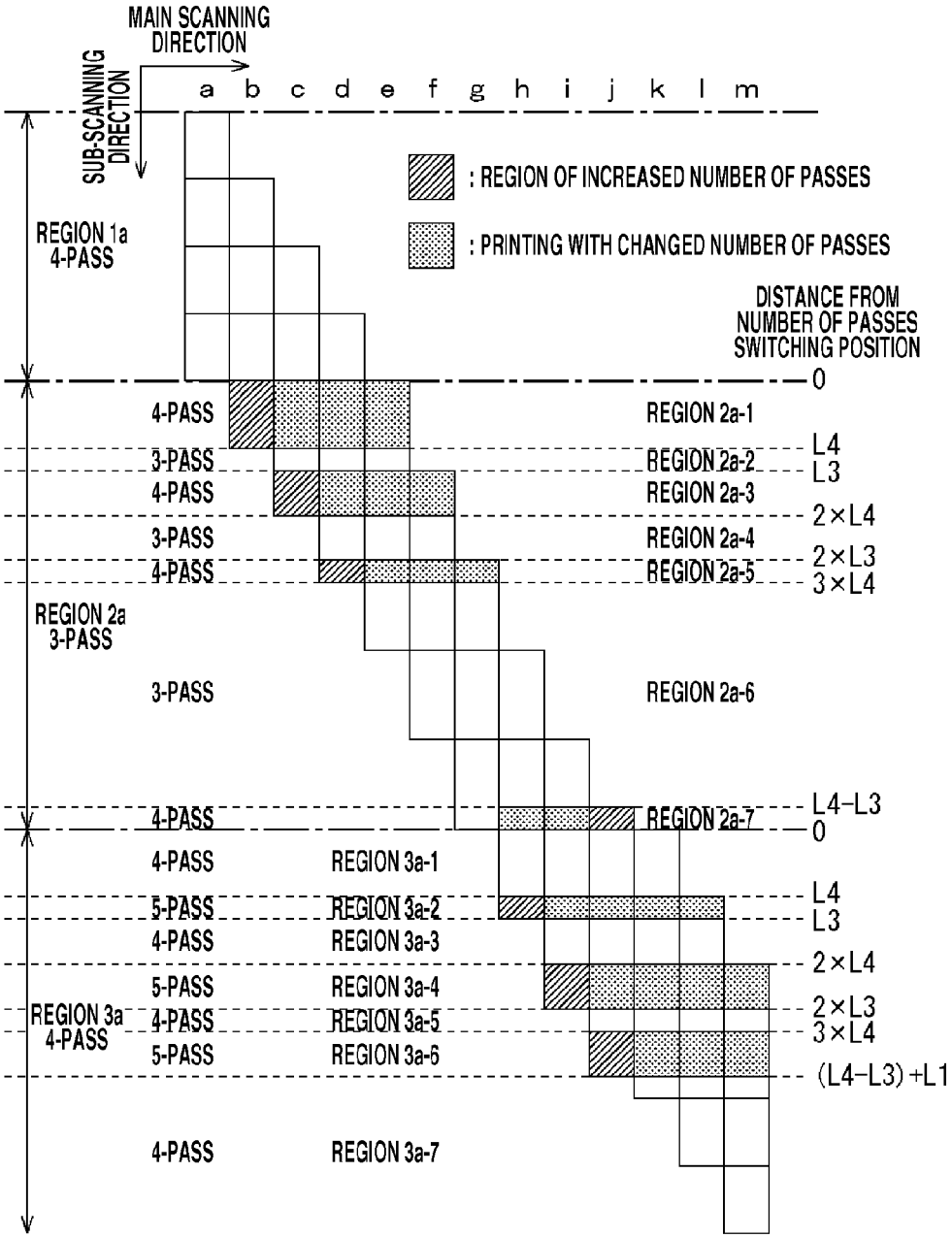
FIG. 8A illustrates a control of a pass number, when the pass number is switched from 4-pass to 3-pass, and after that, the pass number is switched from 3-pass to 4-pass.
Figure 8B:
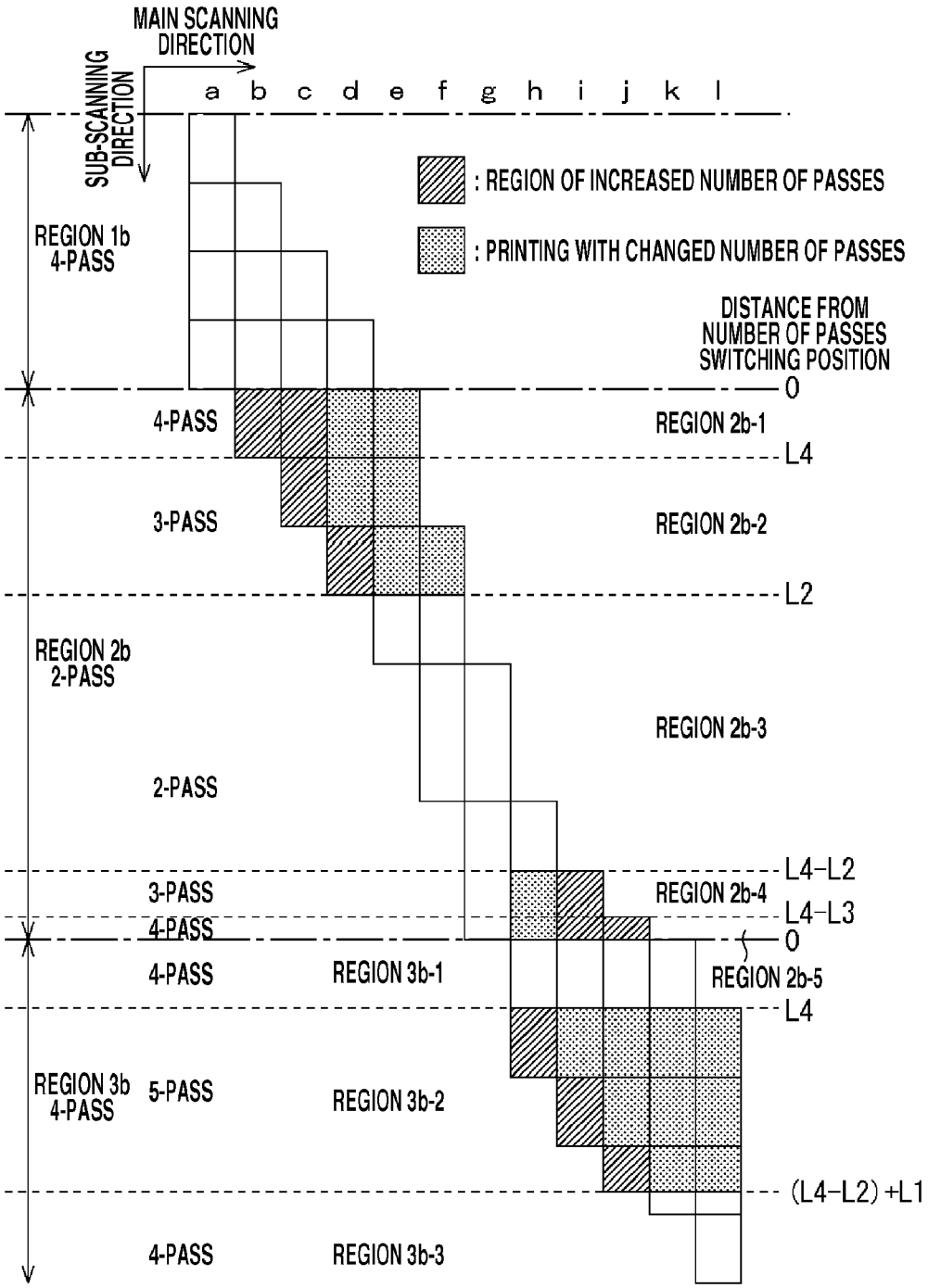
FIG. 8B illustrates a control of a pass number when the pass number is switched from 4-pass to 2-pass, and after that, the pass number is switched from 2-pass to 4-pass.
Figure 8C:
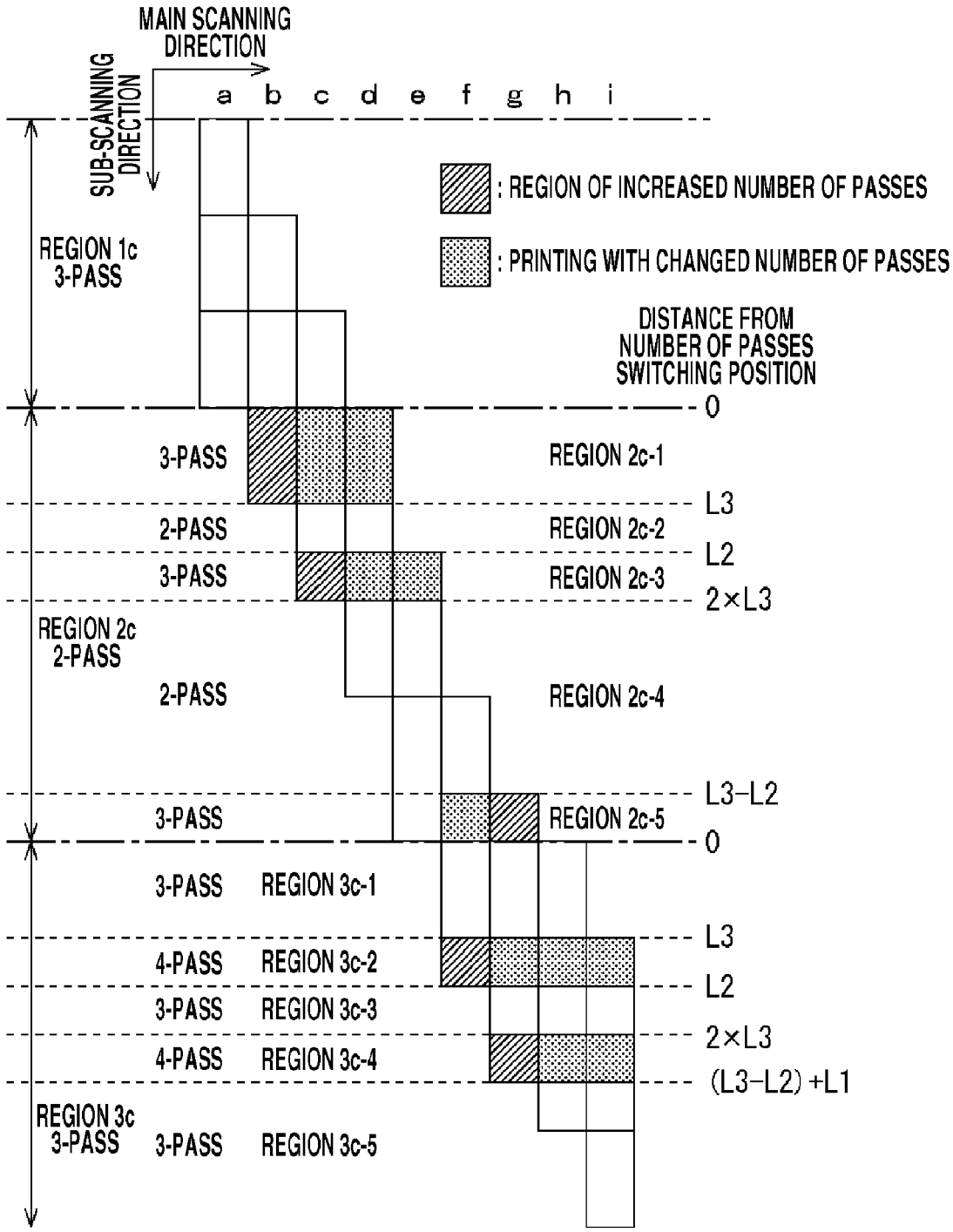
FIG. 8C illustrates a control of a pass number when the pass number is switched from 3-pass to 2-pass, and after that, the pass number is switched from 2-pass to 3-pass.

Next, a method for preventing the appearances of the idle nozzles will be described referring to FIG. 8A through FIG. 8D. FIG. 8A through FIG. 8C illustrate controls in the case where printing is performed on the recording medium to which the pass number illustrated in FIG. 7A through FIG. 7C is allocated, respectively. Further, FIG. 8D illustrates printing widths (lengths of the sub-scanning direction) of the inkjet heads in the multipass printing.

Figure 8D:
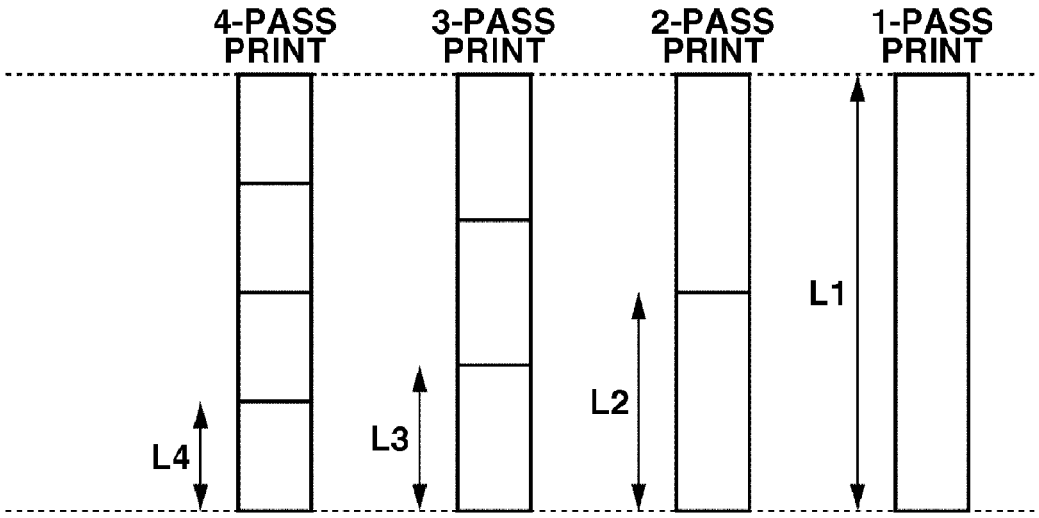
FIG. 8D illustrates print widths (lengths in sub-scanning direction) of an inkjet head in the multipass printing.

As illustrated in FIG. 8D, a printing width for 1-pass portion in the 4-pass print is equal to ¼ width of the inkjet head, and the width is assumed to be L4. The printing width for 1-pass portion in the 3-pass print is equal to ⅓ width of the inkjet head, and the width is assumed to be L3. The printing width for the 1-pass portion in the 2-pass print is equal to ½ width of the inkjet head, and the width is assumed to be L2. The printing width for the 1-pass portion in the 1-pass print is equal to a width of the inkjet head, and the width is assumed to be L1.

Then, in controls illustrated in FIGS. 8A through 8C, idle nozzles in controls illustrated in FIG. 7A through FIG. 7C perform printing with increased pass number. In FIGS. 8A through 8C, a region corresponding to such a nozzle is marked with diagonal lines as a region with increased pass number. Further, along with this, in subsequent states, printing is performed with changed pass division coefficients, namely, with a changed pass number, on a region where printing with increased pass number has been performed. In FIGS. 8A through 8C, the region is represented by bearing dot patterns.

Then, in the example illustrated in FIG. 8A, similarly to the example illustrated in FIG. 7A, when switching is performed from the 4-pass print to the 3-pass print, the recording medium is conveyed by an amount for the 4-pass portion, until reaching a state where the 4-pass print is completed. Then, the conveying amount is changed to the 3-pass print, after the 4-pass print has been completed. When such a conveyance control is performed, in the region 2*a* of the 3-pass print, the 3-pass printing is performed with the feeding amount equivalent to 4-pass. As a result, a mismatch of the feeding amount occurs, and idle nozzles appear in the example illustrated in FIG. 7A. Thus, in the present exemplary embodiment, a conveyance control is performed such that, for example, out of regions 2*a*-1 and 2*a*-2 where inherent 3-pass printing can be performed, the 4-pass printing is performed in the region 2*a*-1 which is a region with the feeding amount equivalent to 4-pass, and the 3-pass printing is performed in the region 2*a*-2.

Then, in the example illustrated in FIG. 8A, the state "b" through the state "g" correspond to a transition period during which switching is performed from the 4-pass print to the 3-pass print. In right end of FIG. 8A, distances from the switching position of pass number are given.

The region 2*a*-1 is a region in which a distance from the pass number switching position is from 0 to L4, and the 4-pass printing is performed therein. The region 2*a*-2 is a region in which a distance from the pass number switching position is from L4 to L3, and 3-pass printing is performed therein. The region 2*a*-3 is a region in which a distance from the pass number switching position is from L3 to 2×L4, and the 4-pass printing is performed. The region 2*a*-4 is a region in which a distance from the pass number switching position is from 2×L4 to 2×L3, and the 3-pass printing is performed therein. The region 2*a*-5 is a region in which a distance from the pass number switching position is from 2×L3 to 3×L4, and the 4-pass printing is performed therein. The region 2*a*-6 is a region in which a distance from the pass number switching position is 3×L4 and beyond, and the 3-pass printing is performed.

Further, the state "h" and beyond correspond to a transition period during which switching is performed from the 3-pass print to the 4-pass print.

In the region 2*a*-7, a distance from the pass number switching position is from L4−L3 to 0, namely, a region short of the switching position of the pass number from the 3-pass print to the 4-pass print, and the 4-pass printing is performed therein. The region 3*a*-1 is a region in which a distance from the switching position of the pass number is from 0 to L4, and the 4-pass printing is performed. The region 3*a*-2 is a region in which a distance from the pass number switching position is from L4 to L3, and a 5-pass printing is performed therein. The region 3*a*-3 is a region in which a distance from the switching position of the pass number is from L3 to 2×L4, and the 4-pass printing is performed therein. The region 3*a*-4 is a region in which a distance from the switching position of the pass number is from 2×L4 to 2×L3, and the 5-pass printing is performed therein. The region 3*a*-5 is a region in which a distance from the switching position of the pass number is from 2×L3 to 3×L4, and the 4-pass printing is performed therein. The region 3*a*-6 is a region in which a distance from the switching position of the pass number is from 3×L4 to (L4−L3)+L1, and the 5-pass printing is performed. The region 3*a*-7 is a region in which a distance from the switching position of the pass number is (L4−L3)+L1 and beyond, and the 4-pass printing is performed therein.

The region 2*a*-7, firstly, is printed as a first-pass of the 3-pass printing in the state "g". Then, after printing in the state "g" has been completed, the pass number is switched from the 3-pass to the 4-pass. More specifically, in the control illustrated in FIG. 7A, a second-pass is printed in the state "h", a third-pass is printed in the state "i", and printing is not performed in the state "j", but in the example illustrated in FIG. 8A, a fourth-pass is printed in the state "j". Thus, pass division coefficients of the state "h" and the state "i" are changed. In other words, redistribution of the pass division coefficients is performed. This is because, if the pass division coefficients are not changed, the sum of the pass division coefficients becomes 1 when the region 2*a*-7 is printed in the state "i", and subsequently if printing is performed in the state "j", excessive printing is carried out. Specific example of redistribution of the pass division coefficient will be described below.

In the example illustrated in FIG. 8B, the state "b" through the state "f" correspond to a transition period during which switching is performed from the 4-pass print to the 2-pass print. On right-end column in FIG. 8B, distances from the switching position of pass number are also given.

The region 2*b*-1 is a region in which a distance from the switching position of the pass number is from 0 to L4, and the 4-pass printing is performed therein. The region 2*b*-2 is a region in which a distance from the switching position of the pass number is from L4 to L2, and the 3-pass printing is performed therein. The region 2*b*-3 is a region in which a distance from the switching position of the pass number is L2 and beyond, and the 2-pass printing is performed therein.

Further, the state "h" and beyond correspond to a transition period during which switching is performed from the 2-pass print to the 4-pass print.

The region 2*b*-4 is a region in which a distance from the pass number switching position is from L4−L2 to L4−L3, namely, a region short of the pass number switching position from the 2-pass print to the 4-pass print, and the 3-pass printing is performed therein. The region 2*b*-5 is a region in which a distance from the pass number switching position is from L4−L3 to 0, namely, a region short of the pass number switching position from the 2-pass print to the 4-pass print, and the 4-pass printing is performed therein. The region 3*b*-1 is a region in which a distance from the pass number switching position is from 0 to L4, and the 4-pass printing is performed therein. The region 3*b*-2 is a region in which a distance from the pass number switching position is from L4 to (L4−L2)+L1, and the 5-pass printing is performed therein. The region 3*b*-3 is a region in which a distance from the pass number switching position is (L4−L2)+L1 and beyond, and the 4-pass printing is performed therein.

In the region 2*b*-4 and the region 2*b*-5, similarly to the region 2*a*-7 in FIG. 8A, pass division coefficients are redistributed from passes in the middle of printing operation.

In the example illustrated in FIG. 8C, the state "b" through the state "e" correspond to a transition period during which switching is performed from the 3-pass print to the 2-pass print. On right-end column in FIG. 8C, distances from the pass number switching position are given.

The region 2*c*-1 is a region in which a distance from the pass number switching position is from 0 to L3, and the 3-pass printing is performed therein. The region 2C-2 is a region in which a distance from the pass number switching position is from L3 to L2, and the 2-pass printing is performed therein. The region 2*c*-3 is a region in which a distance from the pass number switching position is from L2 to 2×L3, and the 3-pass printing is performed therein. The region 2*c*-4 is a region in which a distance from the pass number switching position is 2×L3 and beyond, and the 2-pass printing is performed therein.

Further, the state "f" and beyond correspond to a transition period during which switching is performed from the 2-pass print to the 3-pass print.

The region 2*c*-5 is a region in which a distance from the pass number switching position is from L3−L2 to 0, namely, a region short of the pass number switching position from the 2-pass to the 4-pass, and the 3-pass printing is performed therein. The region 3*c*-1 is a region in which a distance from the pass number switching position is from 0 to L3, and the 3-pass printing is performed therein. The region 3*c*-2 is a region in which a distance from the pass number switching position is from L3 to L2, and the 4-pass printing is performed therein. The region 3*c*-3 is a region in which a distance from the pass number switching position is L2 or 2×L3, and the 3-pass printing is performed therein. The region 3*c*-4 is a region in which a distance from the pass number switching position is from 2×L3 to (L3−L2)+L1, and the 4-pass printing is performed therein. The region 3*c*-5 is a region in which a distance from the pass number switching position is (L3−L2)+L1, and the 3-pass printing is performed therein.

In the region 2*c*-5, similarly to the region 2*a*-7 in FIG. 8A, pass division coefficients are redistributed from passes in the middle of printing operation.

Figure 9:
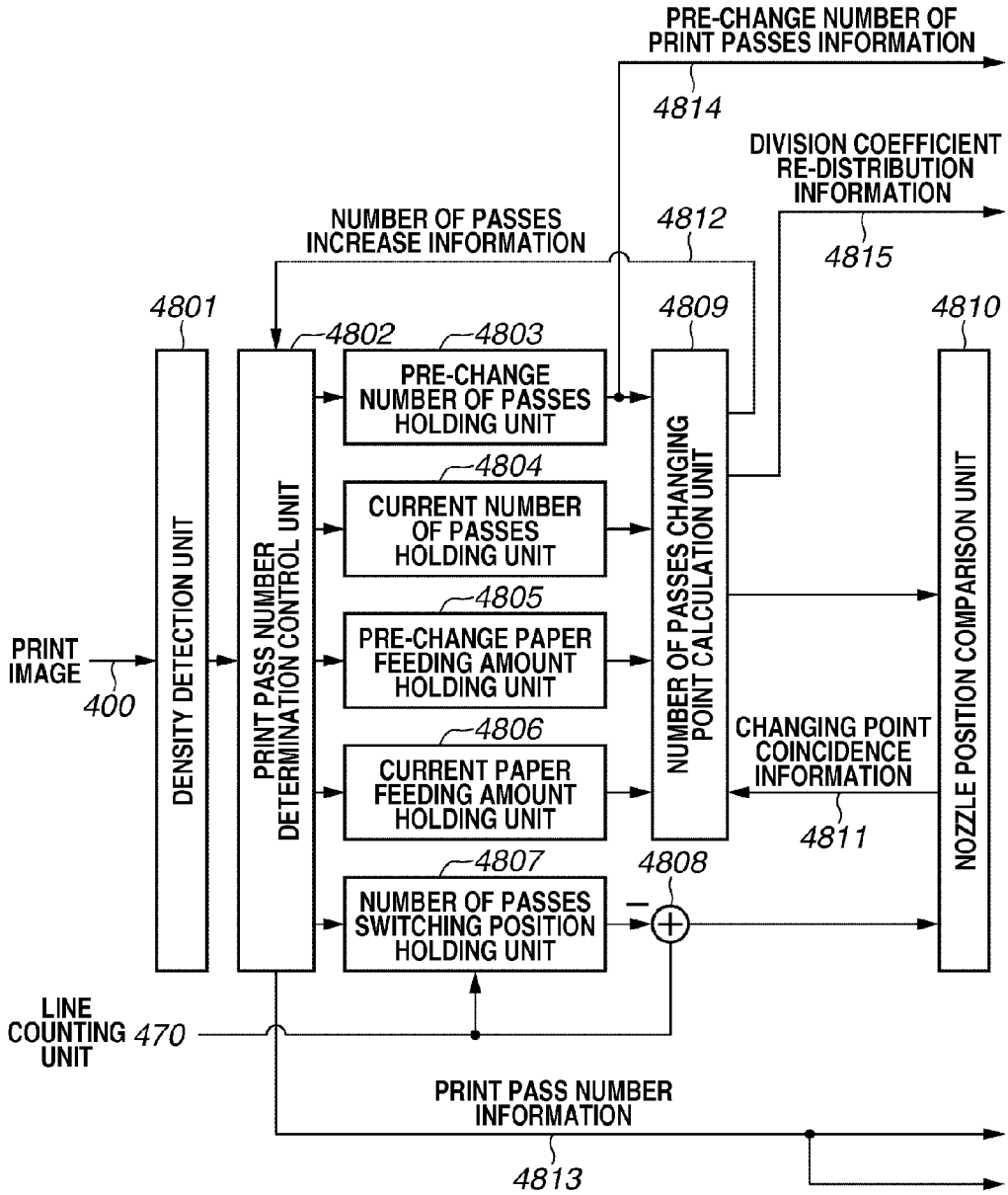
FIG. 9 is a block diagram illustrating a configuration of a print pass number determination unit in the first exemplary embodiment.
Figure 10:
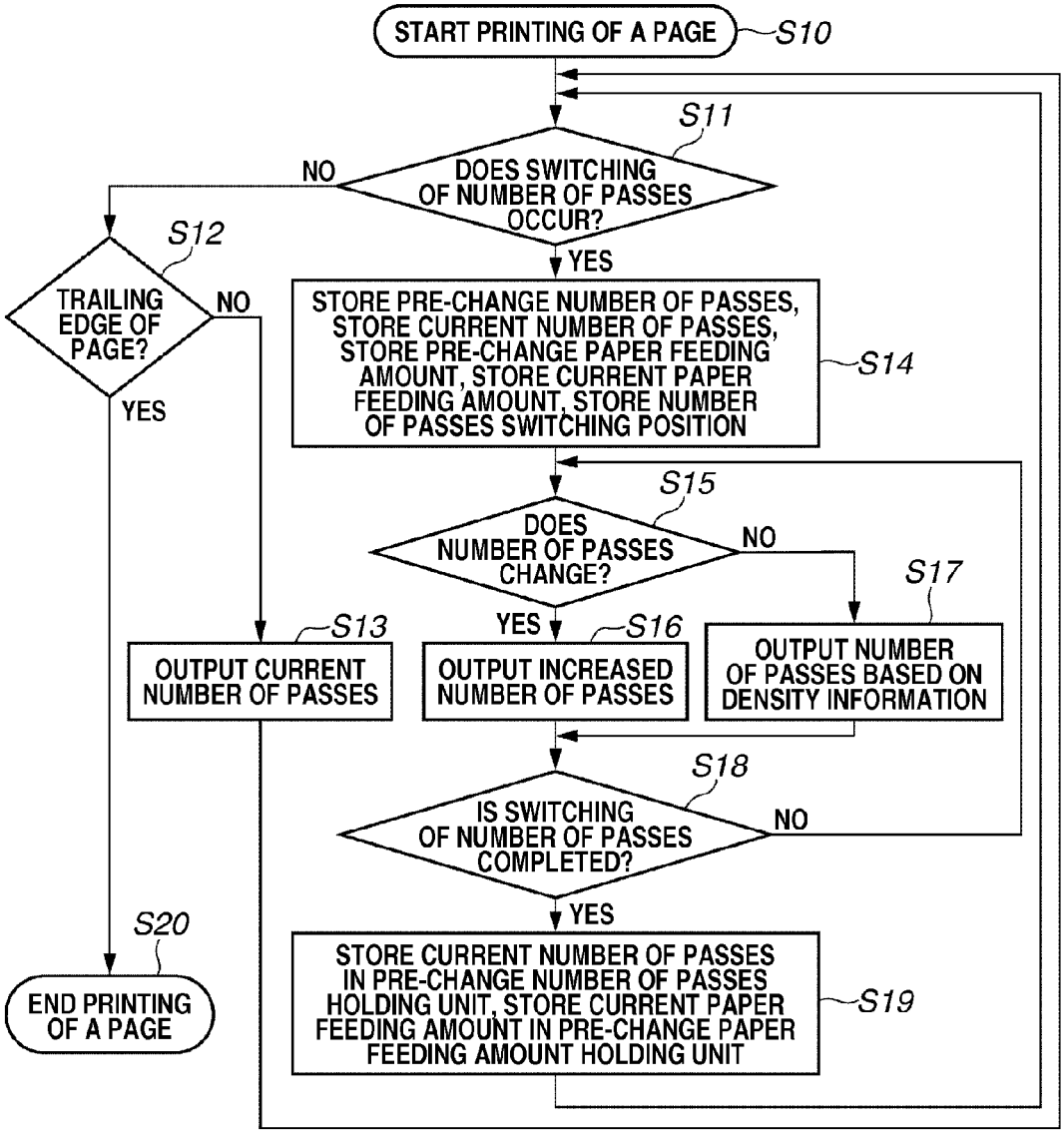
FIG. 10 is a flowchart illustrating a method for determining a number of print passes.

Next, in the first exemplary embodiment, a method for determining a number of print passes in each line, a method for determining whether the number of print passes has increased will be described below. FIG. 9 is a block diagram illustrating a configuration of the print pass number determination unit 480 in the first exemplary embodiment. Further, FIG. 10 is a flowchart illustrating a method for determining the number of print passes.

The print pass number determination unit 480 includes a concentration detection unit 4801, a print pass number determination control unit 4802 for controlling the entire of the print pass number determination unit 480, a pre-change number of passes holding unit 4803, and a current number of passes holding unit 4804. Furthermore, the print pass number determination unit 480 includes a pre-change paper feeding amount holding unit 4805, a current paper feeding amount holding unit 4806, a number of passes switching position holding unit 4807, a subtracter 4808, a number of passes changing point calculation unit 4809, and a nozzle position comparison unit 4810.

The concentration detection unit 4801 detects concentrations that the print image signal 400 indicates, and outputs concentration information to the print pass number determination control unit 4802. A detection method of concentrations is not particularly limited. For example, the concentration information may be obtained (N is arbitrary integer) by taking an average of concentrations of N pixels in the past on the same line from input pixels. Further, a line memory for M−1 lines portion is provided in advance, and the concentration information may be obtained by taking an average of concentrations of a region with N pixels in the main scanning direction, and M pixels in the sub-scanning direction from input pixels (N, M are arbitrary integers).

The print pass number determination control unit 4802 determines a number of passes from the concentration information that the concentration detection unit 4801 outputs, and outputs print pass number information 4813. Determination of the number of passes in the present exemplary embodiment is performed in the following manner, for example. In other words, the criteria are such that, if a value of the concentration information is less than 0.20 or if 0.80 or more, the 2-pass printing is performed. If a value of the concentration information is 0.20 or more and less than 0.35 or if 0.65 or more and less than 0.80, the 3-pass printing is performed. If a value is 0.35 or more and less than 0.65, the 4-pass printing is performed. From the print pass number determination control unit 4802, the print pass number information 4813 is output, and the print pass number information 4813 is input into the pass division table 410, the paper feeding amount control unit 490 and the line counting unit 470. As described above, the pass division table 410 outputs division coefficients depending on the print pass number information 4813, namely, the number of print passes. The paper feeding amount control unit 490 determines a paper feeding amount depending on the print pass number information 4813, and performs paper feeding control of a conveyance portion (not shown in FIG. 4) of the recording medium. The line counting unit 470, when the paper feeding occurs, calculates a number of lines on the recording medium of the next printing, depending on the print pass number information 4813. The paper feeding is performed at the time point when printing by most-backend nozzle of the inkjet head is completed. Therefore, if a paper feeding amount is added to a position of the front-end nozzle of the inkjet head before the paper feeding, a position of the front-end nozzle of the inkjet head after the paper feeding, can be calculated. The paper feeding amount is dependent on the number of print passes.

In step S10, printing of a page is started. In step S11, the print pass number determination control unit 4802 determines whether switching of a pass number occurs. If the switching of the pass number occurs (YES in step S11), then in step S14, a pass number before change of a number of print passes is stored in the pre-change number of passes holding unit 4803, and a pass number after change of a number of print passes is stored in the current number of passes holding unit 4804. Furthermore, in step S14, a paper feeding amount before change of the number of print passes is stored in the pre-change paper feeding amount holding unit 4805, and a paper feeding amount after change of the number of print passes is stored in the current paper feeding amount holding unit 4806. Furthermore, in step S14, an output value of the line counting unit 470, namely, a position of a line on which switching of a pass number has occurred, from the front-end of the recording medium, is stored in the number of passes switching position holding unit 4807.

Then, in step S15, the print pass number determination control unit 4802 determines whether a pass number increases, based on the following three pieces of information.

(1) a pass number before change of a number of print passes (i.e., output of the pre-change number of passes holding unit 4803)

(2) a pass number after change of a number of print passes (i.e., output of the current number of passes holding unit 4804)

(3) a distance between a current line, and a nozzle position at which a switching of the pass number has occurred.

A determination whether a pass number increases is performed in the following manner. Firstly, the subtracter 4808 subtracts output of the pass number switching position holding unit 4807 based on information from the line counting unit 470. More specifically, an output of the subtracter 4808 represents a distance between the current line (line now being scanned) and a nozzle position at which switching of the pass number has occurred. Next, the number of passes changing point calculation unit 4809 calculates a next changing point of the pass number (a distance from the pass number switching position) during the process of a transition of the pass number, and outputs it to the nozzle position comparison unit 4810. An operation of the nozzle position comparison unit 4810 will be described below. Then, a calculation of a changing point is performed using outputs of the pre-change paper feeding amount holding unit 4805 and the current paper feeding amount holding unit 4806, based on outputs of the pre-change number of passes holding unit 4803 and the current number of passes holding unit 4804. For example, in the example illustrated in FIG. 8A, switching is performed from the 4-pass print to the 3-pass print, based on the outputs of the pre-change number of passes holding unit 4803 and the current number of passes holding unit 4804. Further, at this time, L4 is stored in the pre-change paper feeding amount holding unit 4805, and L3 is stored in the current paper feeding amount holding unit 4806. The pass number changing point calculation unit 4809 calculates a changing point, using the paper feeding amount.

Specifically, (1) When 0≦current line≦L4, outputs L4, (2) When L4<current line≦L3, outputs L3, (3) When L3<current line≦2×L4, outputs 2×L4, (4) When 2×L4<current line≦2×L3, outputs 2×L3, (5) When 2×L3<current line≦3×L4, outputs 3×L4.

Regions corresponding to (1), (3) and (5), out of these five regions, become regions where a pass number increases. A switching method of these five regions will be described below.

Then, the number of passes changing point calculation unit 4809 sends a number of print passes increased by the increased number of passes information 4812 to the print pass number determination control unit 4802. The determination whether a pass number has increased is performed in this way.

Then, if a current line is in a region of increased pass number (YES in step S15), then in step S16, the print pass number determination control unit 4802 outputs a pass number based on the increased number of passes information 4812, as the print pass number information 4813. On the other hand, if the current line is not in the region of increased pass number (NO in step S15), then in step S17, the print pass number determination control unit 4802 determines the number of print passes, as described above, based on the concentration information. Consequently, in the example illustrated in FIG. 8A, the 4-pass printing is performed in regions corresponding to (1), (3) and (5), and the 3-pass printing is performed in regions corresponding to (2) and (4).

The nozzle position comparison unit 4810 compares between a next pass number changing point that the number of passes changing point calculation unit 4809 outputs, and an output of the subtracter 4808 (a distance between the current line, and the nozzle position at which a switching of the pass number has occurred). Then, if the both are equal to each other as a result of the comparison (i.e., if the current nozzle is the next changing point of the pass number), the nozzle position comparison unit 4810 asserts changing point coincidence information 4811 to the number of passes changing point calculation unit 4809. Upon receiving the information, the number of passes changing point calculation unit 4809, calculates furthermore a next pass number changing point. In the example illustrated in FIG. 8A, when the switching of the pass number occurs, the number of passes changing point calculation unit 4809 outputs firstly L4 of (1), but changes output values like L3 of (2), 2×L4 of (3), 2×L3 of (4), and 3×L4 of (5), each time the changing point coincidence information 4811 is asserted.

After the processing in step S16 or S17, in step S18, the print pass number determination control unit 4802 determines whether the switching of the pass number is completed. Then, if the switching of the pass number completed (YES in step S18), that is, a transition period of the pass number is completed, then in step S19, the print pass number determination control unit 4802 causes the pre-change number of passes holding unit 4803 to store a current pass number, and causes the pre-change paper feeding amount holding unit 4805 to store a current paper feeding amount.

Further, an output of the pre-change number of passes holding unit 4803 and an output of the current pass number holding unit 4804 become equal to each other, and an output of the pre-change paper feeding amount holding unit 4805 and an output of the current paper feeding amount holding unit 4806 become equal to each other, a value of the increased number of passes information 4812 becomes always 0. More specifically, it is determined that the current line is not in the region of increased pass number at any time. In this case, it is determined that the switching of the pass number has not occurred in step S11, and normal printing is performed. In other words, in step S12, it is determined whether a trailing edge of the page has been reached. If the trailing edge of the page has not been reached (NO in step S12), then in step S13, the current pass number is output.

Next, a method for redistributing pass division coefficients from passes in the middle of printing operation will be described below. In the example illustrated in FIG. 8A, the region 2*a*-7 is a region where the pass division coefficients are redistributed from the passes in the middle of printing operation, and in the example illustrated in FIG. 8B, the region 2*a*-4 and the region 2*a*-5 are regions where the pass division coefficients are redistributed from the passes in the middle of printing operation. Further, in the example illustrated in FIG. 8C, the region 2*a*-6 is a region where the pass division coefficients are redistributed from the passes in the middle of printing operation.

In the present exemplary embodiment, for the purpose of redistribution of the pass division coefficients, two signals other than the print pass number information 4813 are output from the print pass number determination unit 480 to the pass division table 410. The one is pre-change print pass number information 4814 that the pre-change number of passes holding unit 4803 outputs, and another is the division coefficient redistribution information 4815 that the number of passes changing point calculation unit 4809 outputs. The pre-change print pass number information 4814 is the same signal as a signal output from the pre-change number of passes holding unit 4803 to the number of passes changing point calculation unit 4809. The division coefficient redistribution information 4815 is asserted, if a value of a next pass number changing point is 0 in the number of passes changing point calculation unit 4809. A value of a next pass number changing point is 0 in the transition process of the pass number, as described above. This means a region short of the pass number switching position. In other words, it means that the switching of the pass number occurs after a printing of the preceding passes has been completed.

For example, in the example illustrated in FIG. 8A, a value of the next pass number changing point becomes 0 in the region 2*a*-7. Upon receiving the information, the division coefficient redistribution information 4815 is asserted from the number of passes changing point calculation unit 4809. Further, since the region 2*a*-7 is a region of increased pass number, as described above, the print pass number determination control unit 4802 outputs a pass number based on the increased number of passes information 4812 as the print pass number information 4813. In the present exemplary embodiment, a redistribution of the pass division coefficients is performed in the 2nd-pass, irrespective of the number of print passes. In other words, in the example illustrated in FIG. 8A, the 2nd-pass printing of the region 2*a*-7 is performed in the state "h".

When the division coefficient redistribution information 4815 is asserted, using the print pass number information 4813 and the pre-change print pass number information 4814, a redistribution of the pass division coefficients in the pass division table 410 is performed. A pass number of a first pass in which printing is already completed, and an increased pass number of a second-pass and beyond, can be grasped from the pre-change print pass number information 4814 and the print pass number information 4813, respectively. For example, in the case of the region 2*a*-7 of the example illustrated in FIG. 8A, the first-pass has 3 passes, the second-pass and beyond has 4 passes including the first pass on which printing has already been completed. Hence, the remaining number of print passes becomes "4−1=3". Then, a total sum of the remaining pass division coefficients can be obtained. In the case of the 3-pass printing, for example, the inkjet head is equally divided into three regions and each ⅓ of the pass division coefficients are distributed to a region of each head. As described above, the pass division coefficient is ⅓ when the first-pass of the region 2*a*-7 is printed. Hence, a total sum of the remaining pass division coefficients becomes "1−⅓=⅔". If this is equally distributed by the remaining 3 passes, the pass division coefficient per 1 pass becomes "⅔×⅓=⅔". In this way, the pass division coefficients are redistributed from the passes in middle of the printing operation. In the cases of the region 2*a*-4 and the region 2*a*-5 in the example illustrated in FIG. 8B, and also the region 2*a*-6 in the example illustrated in FIG. 8C, redistributions of the pass division coefficients are similarly performed.

Figure 11:
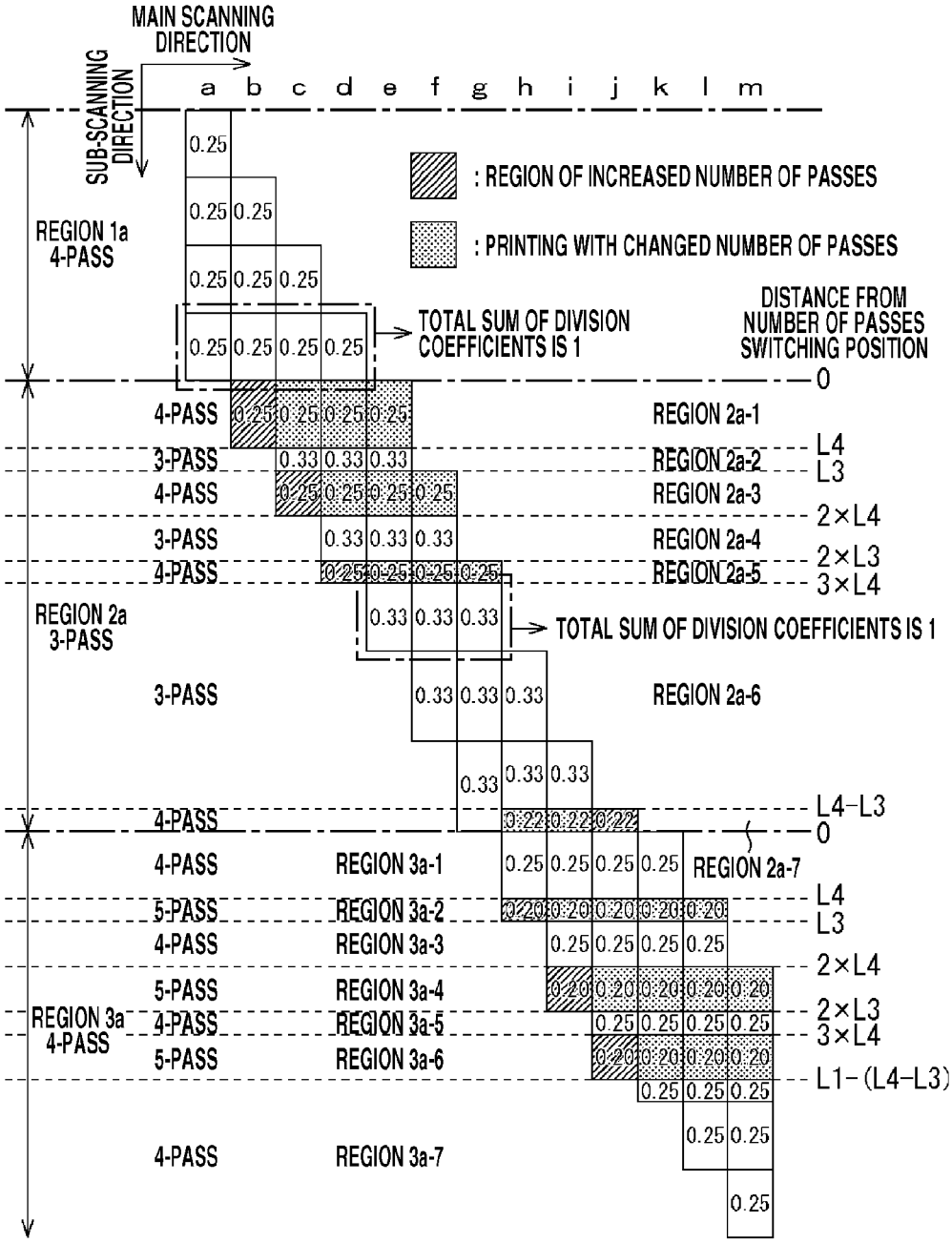
FIG. 11 illustrates a transition of the pass division coefficients in an example illustrated in FIG. 8A.

FIG. 11 illustrates a transition of the pass division coefficients in the example illustrated in FIG. 8A. Numerals in rectangles indicating the inkjet heads in FIG. 11 represent pass division coefficients of blocks (nozzle group) in the heads. As described above, the print pass number determination unit 480 determines a number of print passes for each line, and outputs a pass number of a current line to the pass division table 410. Further, if the current line is in a region of increased pass number, the print pass number determination unit 480 outputs a pass number based on the increased pass number information 4812. Furthermore, for the purpose of redistribution of the pass division coefficients, the print pass number determination unit 480 outputs the pre-change print pass number information 4814 and the division coefficient redistribution information 4815 too.

In the example illustrated in FIG. 11, in the case of the 4-pass print, the pass division coefficients for the same line on the recording medium are equally distributed, each 0.25 for each pass. Also, in the case of the 3-pass print, the pass division coefficients for the same line on the recording medium are equally distributed, each ⅓ (0.33) for each pass. Also, as described above, if the current line is in the region of increased pass number, values of the pass division coefficients based on the increased number of passes information 4812 are obtained.

In other words, in the present exemplary embodiment, the pass division coefficients are changed as appropriate in the state "b" through the state "g", and the state "h" and beyond corresponding to a transition period of the pass number based on the print pass number information 4813, the pre-change print pass number information 4814 and the division coefficient redistribution information 4815 that the print pass number determination unit 480 outputs. In other words, complicated distribution of the pass division coefficients for arbitrary regions of the inkjet heads in which a number of regions and also a width of each region are not fixed, becomes possible.

More specifically, for example, in the state "b", since the region 2*a*-1 is determined to be in the region of increased pass number, and the number of print passes becomes 4, then the pass division coefficient for the region 2*a*-1 becomes 0.25. As described above, a determination whether the current line is in the region of increased pass number, is performed by the number of passes changing point calculation unit 4809. On the other hand, since the remaining regions are targets of the 4-pass print, the pass division coefficients become 0.25.

In the state "c", since the region 2*a*-1 and the region 2*a*-3 are determined to be in the regions of increased pass number, and a number of print passes becomes 4, the pass division coefficients for the region 2*a*-1 and the region 2*a*-3 become 0.25. Further, since the region 2*a*-2 is determined not to be in the region of increased pass number, and the number of print passes becomes 3, then the pass division coefficient for the region 2*a*-2 becomes 0.33. On the other hand, since the remaining regions are targets of the 4-pass print, the pass division coefficients become 0.25.

In the state "d", since the region 2*a*-1, the region 2*a*-3 and the region 2*a*-5 are determined to be in the regions of increased pass number, and the number of print passes becomes 4, the pass division coefficients for the region 2*a*-1, the region 2*a*-3, and the region 2*a*-5 become 0.25. Further, the region 2*a*-2 and the region 2*a*-4 are determined not to be in the regions of increased pass number, and since the number of print passes becomes 3, then the pass division coefficients for the region 2*a*-2 and the region 2*a*-4 becomes 0.33. On the other hand, since the remaining regions are targets of the 4-pass print, the pass division coefficients become 0.25.

In the state "e", since a nozzle in the region 2*a*-6 has completed a transition of the pass number, and the region is a target of normal 3-pass print, the pass division coefficient for the region 2*a*-6 becomes 0.33. On the other hand, out of the remaining regions, since the region 2*a*-1, the region 2*a*-3 and the region 2*a*-5 are determined to be in the regions of increased pass number, and the number of print passes becomes 4, the pass division coefficients for the region 2*a*-1, the region 2*a*-3, and the region 2*a*-5 become 0.25. Further, since the region 2*a*-2 and the region 2*a*-4 are determined not to be in the regions of increased pass number, and the number of print passes becomes 3, the pass division coefficients for the region 2*a*-2 and the region 2*a*-4 become 0.33.

In the state "f", since a nozzle in the region 2*a*-6 has completed a transition of the pass number, and the region is a target of the normal 3-pass print, the pass division coefficient for the region 2*a*-6 becomes 0.33. On the other hand, out of the remaining regions, since the region 2*a*-3 and the region 2*a*-5 are determined to be in the regions of increased pass number, and the number of print passes becomes 4, the pass division coefficients for the region 2*a*-3 and the region 2*a*-5 become 0.25. Since the region 2*a*-4 is determined not be in the region of increased pass number, and the number of print passes becomes 3, the pass distribution coefficient for the region 2*a*-4 becomes 0.33.

In the state "g", since a nozzle in the region 2*a*-6 has completed a transition of the pass number, and the region is a target of the normal 3-pass print, the pass division coefficient for the region 2*a*-6 becomes 0.33. On the other hand, since the remaining region 2*a*-5 is determined to be in the region of increased pass number, and the number of print passes becomes 4, the pass division coefficient for the region 2*a*-5 becomes 0.25.

In the state "h", since the region 3*a*-2 is determined to be in the region of increased pass number, and the number of print passes becomes 5, the pass division coefficient for the region 3*a*-2 becomes 0.20. Further, since the region 3*a*-1 is determined not to be in the region of increased pass number, and the number of print passes becomes 4, the pass division coefficient for the region 3*a*-1 becomes 0.25. Further, for the region 2*a*-7, the pass division coefficients are redistributed as described above and the pass division coefficient for the region 2*a*-7 becomes 0.22. On the other hand, since the remaining region is a target of the 3-pass print, the pass division coefficient becomes 0.33.

In the state "i", since the region 3*a*-2 and the region 3*a*-4 are determined to be in the regions of increased pass number, and the number of print passes becomes 5, the pass division coefficients for the region 3*a*-2 and the region 3*a*-4 become 0.20. Since the region 3*a*-1 and the region 3*a*-3 are determined not to be in the regions of increased pass number, and the number of print passes becomes 4, then the pass division coefficients for the region 3*a*-1 and the region 3*a*-3 become 0.25. For the region 2*a*-7, the pass division coefficients are redistributed, and the pass division coefficient for the region 2*a*-7 becomes 0.22. On the other hand, since the remaining region is a target of the 3-pass print, the pass division coefficient becomes 0.33.

In the state "j", since the region 3*a*-2, the region 3*a*-4 and the region 3*a*-6 are determined to be in the regions of increased pass number, and the number of print passes becomes 5, the pass division coefficients for the region 3*a*-2, the region 3*a*-4 and the region 3*a*-6 become 0.20. Since the region 3*a*-1, the region 3*a*-3, and the region 3*a*-5 are determined not to be in the regions of increased pass number, and the number of print passes becomes 4, the pass division coefficients for the region 3*a*-1, the region 3*a*-3, and the region 3*a*-5 become 0.25. For the region 2*a*-7, the pass division coefficients are redistributed, and the pass division coefficient for the region 2*a*-7 becomes 0.22.

In the state "k", since a nozzle in the region 3*a*-7 has completed a transition of the pass number, and the region is a target of normal 4-pass print, the pass division coefficient for the region 3*a*-7 becomes 0.25. On the other hand, since the region 3*a*-2, the region 3*a*-4 and the region 3*a*-6, out of the remaining regions, are determined to be in the regions of increased pass number, and the number of print passes becomes 5, the pass division coefficients for the region 3*a*-2, the region 3*a*-4 and the region 3*a*-6 become 0.20. Since the region 3*a*-1, the region 3*a*-3, and the region 3*a*-5 are determined not to be in the regions of increased pass number, and the number of print passes becomes 4, the pass division coefficients for the region 3*a*-1, the region 3*a*-3 and the region 3*a*-5 become 0.25.

In the state "l", since a nozzle in the region 3*a*-7 has completed a transition of the pass number, and the region is a target of the normal 4-pass print, the pass division coefficient for region 3*a*-7 becomes 0.25. On the other hand, since the region 3*a*-2, the region 3*a*-4, and the region 3*a*-6, out of the remaining regions, are determined to be in the regions of increased pass number, and the number of print passes becomes 5, the pass division coefficients for the region 3*a*-2, the region 3*a*-4, and the region 3*a*-6 become 0.20. Since the region 3*a*-3 and the region 3*a*-5 are determined not to be in the regions of increased pass number, and the number of print passes becomes 4, the pass division coefficients for the region 3*a*-3 and the region 3*a*-5 become 0.25.

In the state "m", since a nozzle in the region 3*a*-7 has completed a transition of the pass number, and the region is a target of the normal 4-pass print, the pass division coefficient for the region 3*a*-7 becomes 0.25. On the other hand, since the region 3*a*-4 and the region 3*a*-6, out of the remaining regions, are determined to be in the regions of increased pass number, and the number of print passes becomes 5, the pass division coefficients for the region 3*a*-4 and the region 3*a*-6 becomes 0.20. Since the region 3*a*-5 is determined not to be in the region of increased pass number, and the number of print passes becomes 4, the pass division coefficient for region 3*a*-5 becomes 0.25.

The recording medium (paper) is conveyed each L4, even after the state "m", and the pass division coefficients are distributed in the similar method, until all nozzles of the inkjet head reach the region 3*a*-7.

In either of the example illustrated in FIG. 8B, and the example illustrated in FIG. 8C, similar settings of the pass division coefficients are performed. Further, even if switching of another pass number is performed, similar settings of the pass division coefficient are performed.

According to the first exemplary embodiment as described above, in a transition period during which a pass number is switched, printing is performed by adjusting the pass division coefficients, and using all nozzles. Thus, use of nozzles is distributed, and the uneven concentration can be reduced. Further, since switching lines of the number of print passes are distributed when the pass number is switched, boundary becomes less noticeable, and the pass number can be also locally increased. Thus, an image in which uneven concentration is even less noticeable can be formed. Furthermore, since non-used nozzles disappear, use rate of the nozzles is averaged, and lifetime of heads can be also extended.

In the first exemplary embodiment, a pass number is determined from concentration average in proximity to a target pixel, but it is not limited to this embodiment. For example, the pass number may be determined based on concentration distribution in proximity to the pixel of interest. In this case, the concentration distribution is only necessary for the purpose of determining the pass number. Accordingly, the pass number can be determined based on a count value (frequency), for example, in the following manner. (a) count value of less than 0.20 or not less than 0.80, (B) count value of not less than 0.20 and less than 0.35 or not less than 0.65 and less than 0.80, and (C) count value of not less than 0.35 and less than 0.65 are obtained, and then the pass number may be determined in the order from the highest frequency. Alternatively, the pass number may be determined according to order of priority as follows: (d) if a count value of not less than 0.35 and less than 0.65 is not less than a threshold value, 4-pass is used. (e) if a count value of not less than 0.35 and less than 0.65 is less than the threshold value, and, a count value of not less than 0.20 and less than 0.35, or not less than 0.65 and less than 0.80 is not less than the threshold value, 3-pass is used. (f) if a count value of not less than 0.35 and less than 0.65 is less than the threshold value, and, a count value of not less than 0.20 and less than 0.35, or of not less than 0.65 and less than 0.80 is less than the threshold value, 2-pass is used. In this way, the pass number may be determined by sorting out the priorities.

Figure 12:
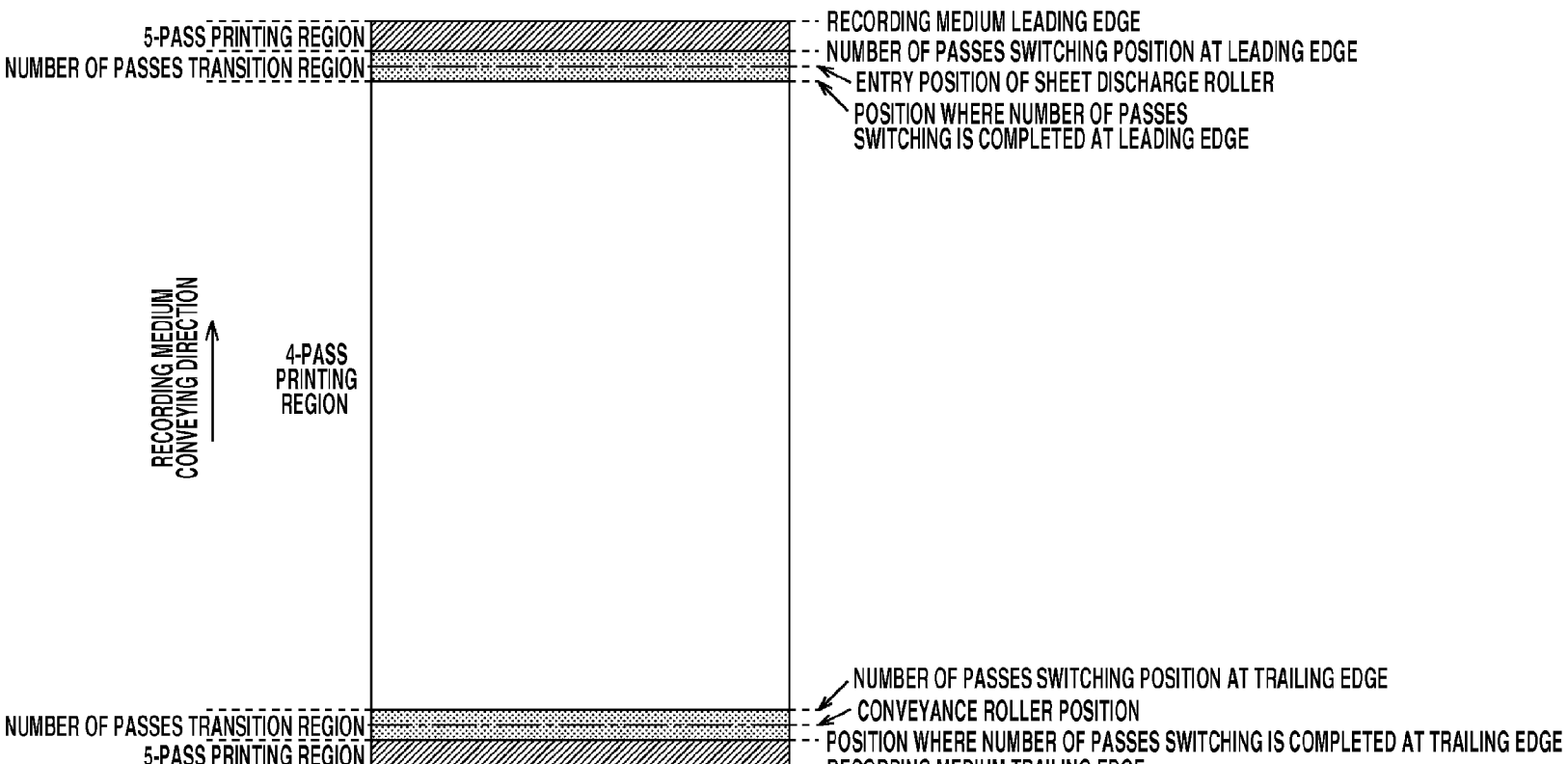
FIG. 12 illustrates a relationship among entry position of a sheet discharge roller, a conveyance roller position, and a pass number switching position in the recording medium.

Next, a second exemplary embodiment will be described below. The second exemplary embodiment is an example in which a print control in the first exemplary embodiment is applied to the recording at the leading edge and the trailing edge in the conveying direction of the recording medium. FIG. 12 illustrates a relationship among entry position of a sheet discharge roller, a conveyance roller position and a pass number switching position in the recording medium.

In the present exemplary embodiment, as illustrated in FIG. 12, the 5-pass printing is performed from the leading edge of the recording medium to a predetermined range. Then, the printing is switched to the 4-pass printing at the pass number switching position at leading edge before a position where the leading edge of the recording medium enters the sheet discharge roller (corresponding to a sheet discharge roller 750 in FIG. 16). At this time, until a position where the pass number switching is completed at leading edge has been reached, a fine pass number switching is performed, as described below, in accordance with the first exemplary embodiment. Then, in the transition period of the pass number, the recording medium enters the sheet discharge roller. A conveyance amount at one time is made less than the 4-pass print by performing such a control, and a conveyance error which occurs when the recording medium enters the sheet discharge roller can be reduced. Furthermore, at a portion where conveyance accuracy is deteriorated, not only the number of print passes is increased, but also an idle nozzle is used for printing in a transition period during which a pass number is switched. As a consequence, switching lines of the number of print passes can be dispersed to make boundaries less noticeable. Accordingly, an image in which uneven concentration is furthermore less noticeable, can be formed.

Figure 16A:
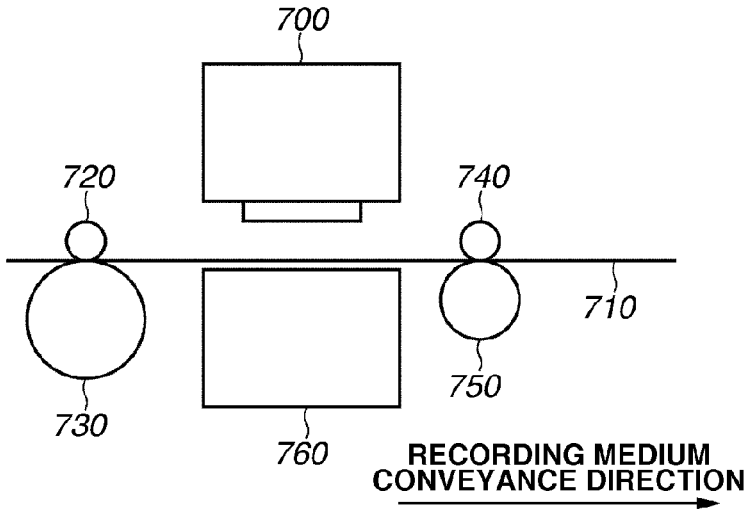
FIG.16A PRIOR ART
FIGS. 16A and 16B illustrate an outline of conventional inkjet printer.
Figure 16B:
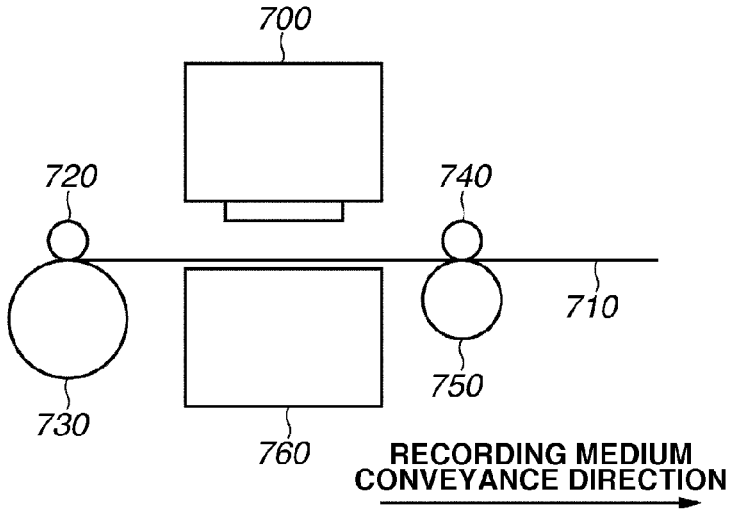
FIG.16B PRIOR ART

Also, in the trailing edge of the recording medium, a pass number is switched from the 4-pass print to the 5-pass print at the pass number switching position at trailing edge before a position where the trailing edge of the recording medium comes out of the conveyance roller (corresponding to the conveyance roller 730 in FIG. 16). At this time, until a position where pass number switching is completed at trailing edge has been reached, a fine pass number switching is performed as described below, in accordance with the first exemplary embodiment. Then, the recording medium comes out of the conveyance roller in the transition period of the pass number. Then, 5-pass printing is performed from the position where pass number switching at an end portion is completed, to the trailing edge of the recording medium.

Figure 13A:
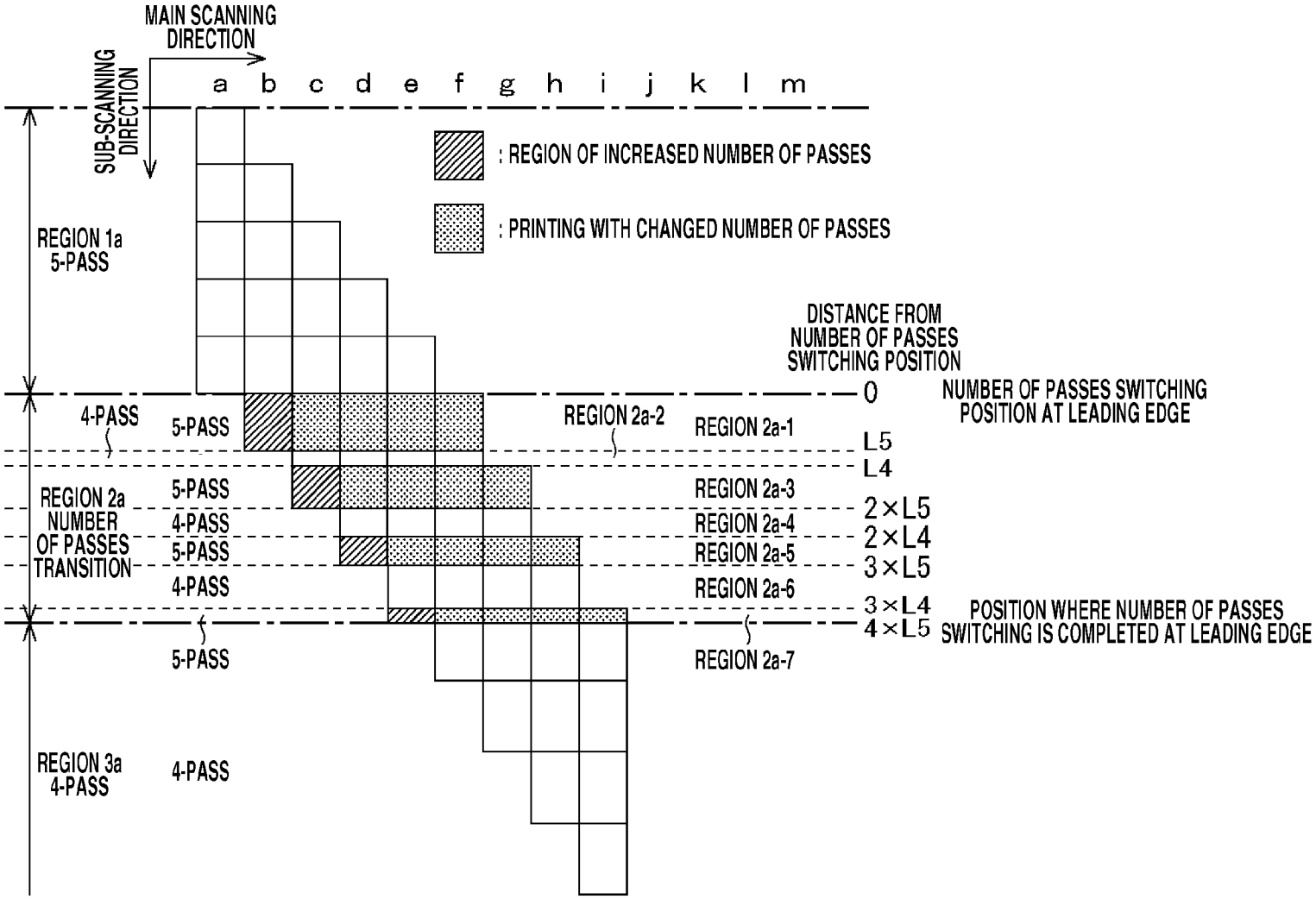
FIG. 13A illustrates a switching control of a number of print passes in proximity to the pass number switching position at leading edge in FIG. 12.
Figure 13B:
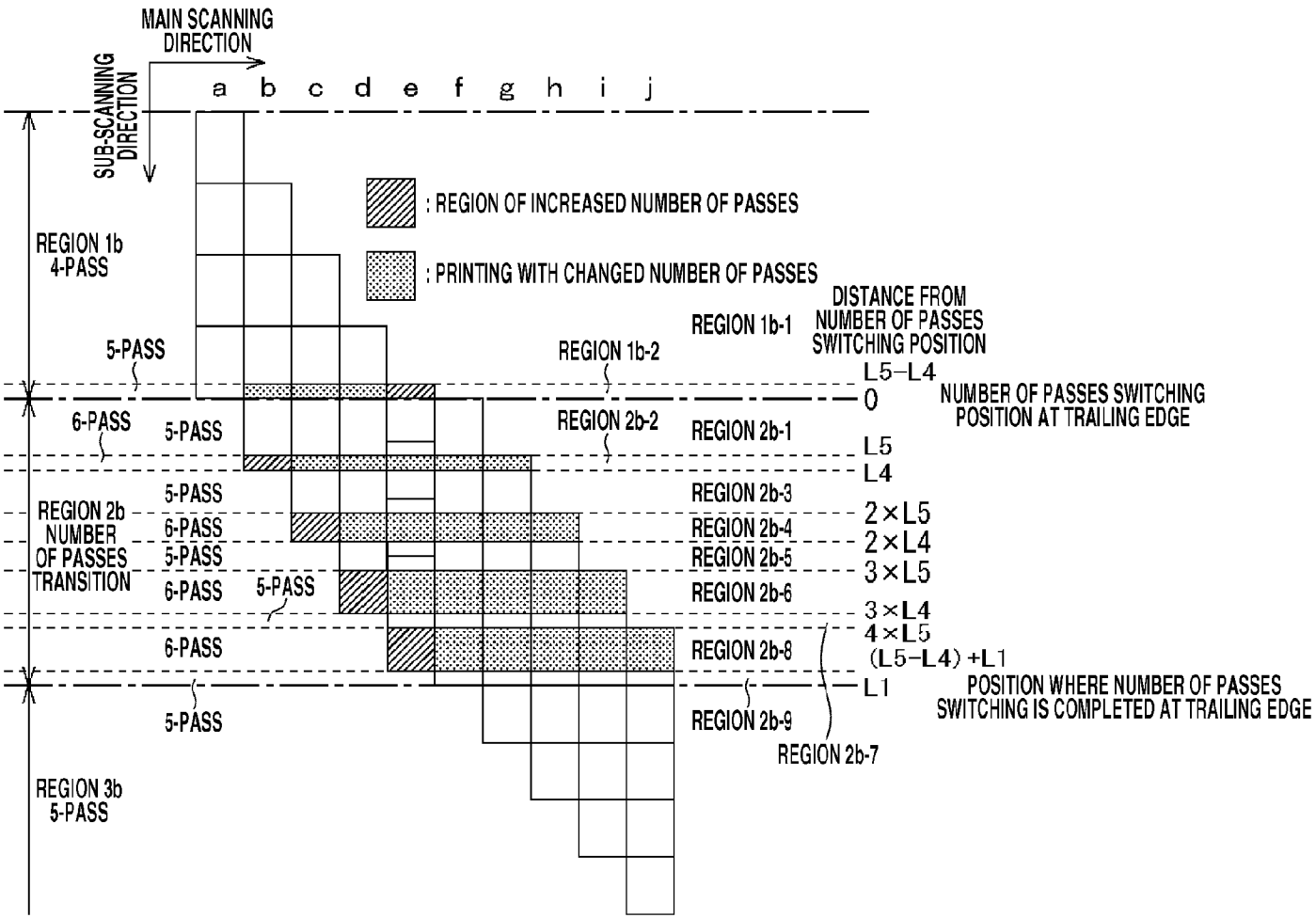
FIG. 13 B illustrates a switching control of a number of print passes in proximity to the pass number switching position at trailing edge in FIG. 12.

FIGS. 13A and 13B illustrate a switching control of the number of print passes in proximity to the pass number switching position in FIG. 12. In other words, FIGS. 13A and 13B correspond to FIGS. 8A through 8C in the first exemplary embodiment. In FIGS. 13A and 13B, L5 is a paper feeding amount of the 5-pass print, and is equal to ⅕ of a head width of the inkjet head.

FIG. 13A illustrates a switching control of the number of print passes in proximity to the pass number switching position at leading edge in FIG. 12. Here, the inkjet head and the recording medium that undergo a transition in succession will be described below based on 13 states from the state "a" to the state "m". The region 1*a* of the recording medium is a region from the leading edge of the recording medium to the pass number switching position at a front portion, and is a target of the 5-pass print. The region 2*a* is a region where a transition of the pass number is performed and a region 3*a* is a target of the 4-pass print. In the region 2*a*, similarly to the first exemplary embodiment, printing is performed by using all nozzles while finely switching the number of print passes. The state "b" through the state "i" correspond to a transition period during which the number of print passes is switched from the 5-pass print to the 4-pass print. On right-end column in FIG. 13A, distances from the pass number switching position are given.

In the region 2*a*-1, a distance from the pass number switching position is from 0 to L5, and the 5-pass printing is performed therein. In the region 2*a*-2, a distance from the pass number switching position is from L5 to L4, and the 4-pass printing is performed therein. In the region 2*a*-3, a distance from the pass number switching position is from L4 to 2×L5, and the 5-pass printing is performed therein. In the region 2*a*-4, a distance from a pass number switching position is from 2×L5 to 2×L4, and the 4-pass printing is performed therein. In the region 2*a*-5, a distance from the pass number switching position is from 2×L4 to 3×L5, and the 5-pass printing is performed therein. In the region 2*a*-4, a distance from the pass number switching position is from 3×L5 to 3×L4, and the 4-pass printing is performed therein. In the region 2*a*-7, a distance from the pass number switching position is from 3×L4 to 4×L5, and the 5-pass printing is performed therein. In the region 3*a*, a distance from the pass number switching position is 4×L5 and beyond, and the 4-pass printing is performed therein.

FIG. 13B illustrates a switching control of the number of print passes in proximity to the pass number switching position at trailing edge in FIG. 12. In this process, descriptions will be given, based on 10 states from the state "a" to the state "j" of the inkjet head and the recording medium that undergo a transition in succession. The region 1*b* is a target of the 4-pass print and the region 2*b* is region where a transition of the pass number is performed. The region 3*b* covers an area from the pass number switching position at trailing edge to the trailing edge of the recording medium, and is a target of the 5-pass print. In the region 2*b*, similarly to the first exemplary embodiment, printing is performed by using all nozzles while finely switching the number of print passes. The state "b" though the state "i" correspond to a transition period in which the number of print passes is switched from the 4-pass print to the 5-pass print. Also on right-edge column in FIG. 13B, distances from the pass number switching position are given.

The region 1*b*-2 is a region in which a distance from the pass number switching position is from L5−L4 to 0, namely, a region short of the pass number switching position from 4-pass to the 5-pass, and the 5-pass printing is performed therein. In the region 2*b*-1, a distance from the pass number switching position is from 0 to L5, and the 5-pass printing is performed therein. In the region 2*b*-2, a distance from the pass number switching position is from L5 to L4, and the 6-pass printing is performed therein. In the region 2*b*-3, a distance from the pass number switching position is from L4 to 2×L5, and the 5-pass printing is performed therein. In the region 2*b*-4, a distance from the pass number switching position is from 2×L5 to 2×L4, and the 6-pass printing is performed therein. In the region 2*b*-5, a distance from the pass number switching position is from 2×L4 to 3×L5, and the 5-pass printing is performed therein. In the region 2*b*-6, a distance from the pass number switching position is from 3×L5 to 3×L4, and the 6-pass printing is performed therein. In the region 2*b*-7, a distance from the pass number switching position is from 3×L4 to 4×L5, and the 5-pass printing is performed therein. In the region 2*b*-8, a distance from the pass number switching position is from 3×L5 to (L5−L4)+L1, and the 6-pass printing is performed therein. In the region 2*b*-9, a distance from the pass number switching position is from (L5−L4)+L1 to L1, and the 5-pass printing is performed. In the region 3*b*, a distance from the pass number switching position is L1 and beyond, and the 5-pass printing is performed up to the trailing edge of the recording medium.

The region 1*b*-2, firstly, is printed as the first-pass of the 4-pass print in the state "a". Then, after printing is completed in the state "a", the pass number is switched from the 4-pass to the 5-pass. More specifically, in a control based on FIG. 7A, the second-pass is printed in the state "b", the third-pass is printed in the state "c", the fourth-pass is printed in the state "d", and printing is not performed in the state "e". However, in the example illustrated in FIG. 13B, the fifth-pass is printed in state "e". Thus, pass division coefficients in the state "b" through the state "e" are redistributed. A redistribution of the pass division coefficients is performed similarly to the first exemplary embodiment.

Further, in the examples illustrated in FIGS. 13A and 13B, although the 5-pass printing is performed in the leading edge and the trailing edge of the recording medium, printing may also be performed there in the pass number of more than 5 passes.

Figure 14:
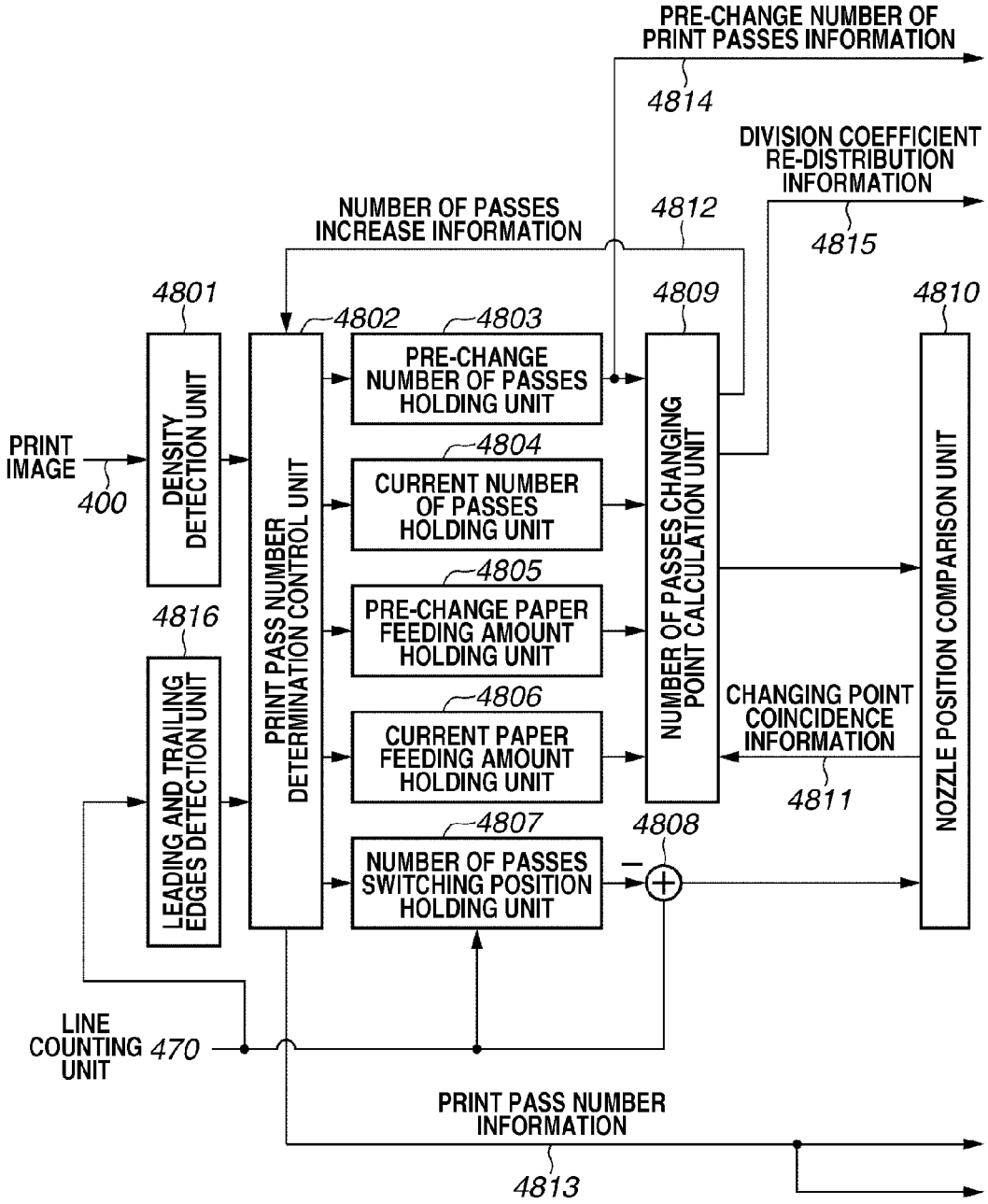
FIG. 14 is a block diagram illustrating a configuration of the print pass number determination unit in a second exemplary embodiment.

Next, a method for determining a number of print passes in each line in the second exemplary embodiment will be described below. FIG. 14 is a block diagram illustrating a configuration of the print pass number determination unit 480 in the second exemplary embodiment.

In the present exemplary embodiment, a leading and trailing edges detection unit 4816 is additionally included in the print pass number determination unit 480 in the first exemplary embodiment. The leading and trailing edges detection unit 4816 refers to information from the line counting unit 470 to detect the leading edge and the trailing edge of the recording medium. In the present exemplary embodiment, a number of lines from the leading edge of the recording medium of the pass number switching position at an front portion, and a number of lines from the trailing edge of the recording medium of the pass number switching position at an end portion, are set in a setting register (not shown) for each product model. Then, the leading and trailing edges detection unit 4816 compares between a value of the setting register and a value of the information from the line counting unit 470, to detect the leading edge and the trailing edge of the recording medium.

When a detection by the leading and trailing edges detection unit 4816 is performed, the print pass number determination control unit 4802 performs pass number switching control illustrated in FIG. 13A or 13B, irrespective of the concentration information that the concentration detection unit 4801 outputs. More specifically, a determination result of the leading and trailing edges detection unit 4816 in conjunction with the concentration information that the concentration detection unit 4801 outputs is added to a determination condition of the increased pass number in step S15 in the flowchart in FIG. 10, and, a determination result of the leading and trailing edges detection unit 4816 is given priority.

Other configurations and operations are similar to those in the first exemplary embodiment.

Figure 15:
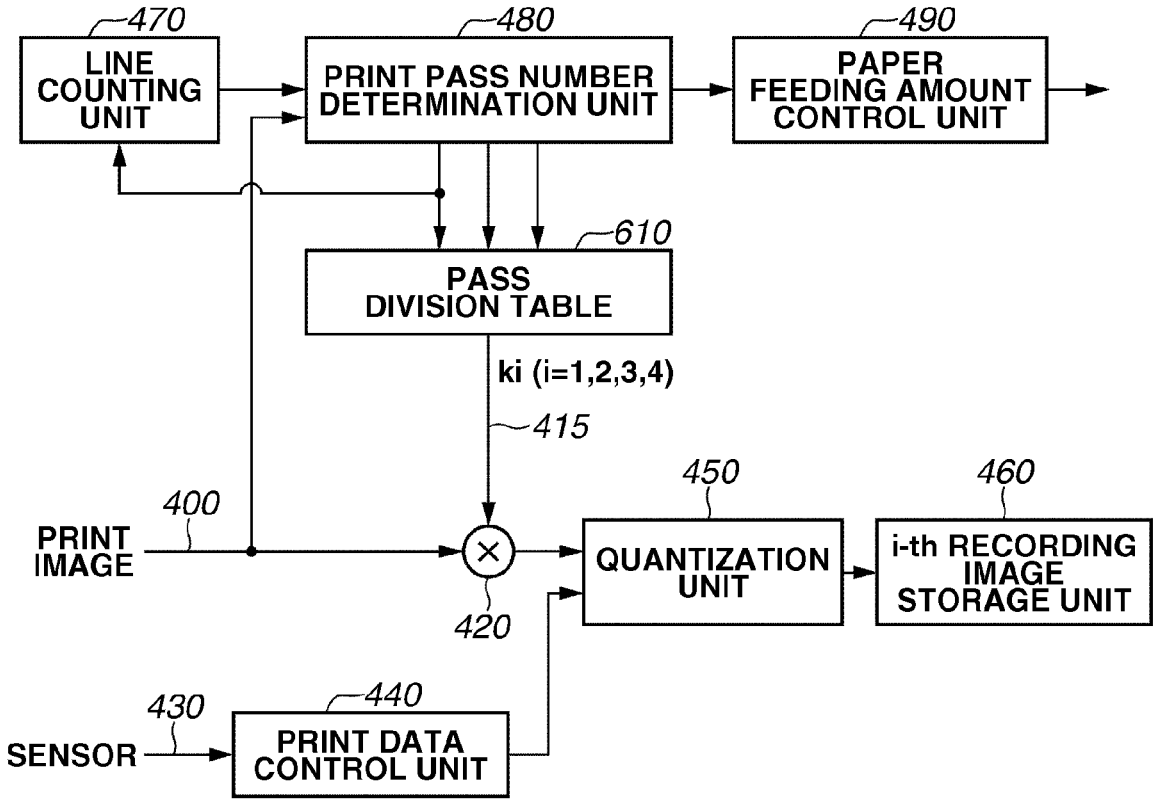
FIG. 15 is a block diagram illustrating a configuration of the print data generation unit in a third exemplary embodiment.

In this way, in the present exemplary embodiment, while performing a control of print duty illustrated in FIG. 12 (a control to make print duty of edges lower than an internal print duty), in addition a pass switching control illustrated in FIGS. 13A and 13B is performed. By performing the print duty control illustrated in FIG. 12, deterioration of image quality in the leading and trailing edges of the recording medium can be prevented, and an image formation with a high image quality can be performed. Furthermore, the number of print passes is increased at the leading and trailing edges of the recording medium by performing a control illustrated in FIGS. 13A and 13B, and in addition, all nozzles are used for printing in a transition period during which the pass number is switched. As a result, it becomes possible to disperse the switching lines of the number of print passes, and to make the boundaries to be less noticeable. Thus, furthermore an image can be formed in which uneven concentration is less noticeable Next, a third exemplary embodiment will be described below. In the third exemplary embodiment, a configuration of the print data generation unit 370_*x* differs from the first exemplary embodiment. FIG. 15 is a block diagram illustrating a configuration of the print data generation unit 370_*x* in the third exemplary embodiment. In the present exemplary embodiment, processing in the print data generation unit 370_*x* is sequentially performed. Other configurations are similar to those in the first exemplary embodiment.

As illustrated in FIG. 15, the print data generation unit 370_*x*, similarly to the first exemplary embodiment, is provided with the line counting unit 470, the print pass number determination unit 480, and the paper feeding amount control unit 490. Further, the pass division table 410 stores coefficients for division into multipass, and outputs the division coefficients depending on the number of print passes determined by the print pass number determination unit 480. From the pass division table 610, similarly to the pass division table 410, pass division coefficients k1 (i=1, 2, 3, 4) of the first pass can be read out.

The print data generation unit 370_*x* is provided with the multiplier 420. The multiplier 420 multiplies a print image signal (a signal corresponding to 335_*x* in FIG. 3) 400 converted into each ink color by the color conversion unit 330, by a pass division coefficient ki (415) of each pass, and calculates a print concentration of each pass. A pass division coefficient of each pass is equivalent to a print concentration ratio of each pass.

The print data generation unit 370_*x* is provided with the print data control unit 440 for generating control data for print data generation, according to a signal 430(*a* signal corresponding to 355_*x* in FIG. 3) from the sensor 340 which is converted into CMY by the color conversion unit 350.

The print data generation unit 370_*x* is provided with the quantization unit 450. The quantization unit 450 generates print data of each pass under control of the print data control unit 440 with respect to outputs of the multiplier 420 that has calculated a print concentration of each pass that has undergone pass division.

The print data generation unit 370_*x* is provided with an i-th pass recording image storage unit 460. The i-th pass recording image storage unit 460 stores temporarily outputs of the quantization unit 450 that has generated print data of each pass, as a recorded image of an i-th pass.

Similarly in the third exemplary embodiment, as illustrated in FIG. 6, the print image signal 400 that has been subjected to CMY conversion, and the signal 430 detected by the sensor, read out, and subjected to the CMY conversion, are scanned in a row direction across a printing region 205 in FIG. 6.

In the image processing unit 150 provided with the print data generation unit 370_*x* thus configured, firstly, the pass division coefficient ki read out from the pass division table 610 according to a region of each pass and the print image signal 400 are multiplied by the multiplier 420, and a print concentration depending on a pass region is calculated. Then, correction of concentration level and generation of control data are performed by the print data control unit 440 according to a signal 430 from the sensor. Print data according to each pass is generated by the quantization unit 450, under control using the control data. The generated print data is temporarily stored in the i-th pass recording image storage unit 460, and printing is performed on the recording medium by the print control unit 160, thereby an image is formed. Regarding the first-pass, since print data before the first-pass does not exist, the control signal is not input. For this reason, for the first-pass, the quantization unit 450 quantizes input print concentration as it is.

Other configurations and operations such as a distributing control using all nozzles are similar to those in the first exemplary embodiment.

Also according to such third exemplary embodiment, the effects similar to the ones in the first exemplary embodiment can be obtained.

When the 3-pass printing is performed in the configuration in FIG. 15, pass division coefficients k1, k2, k3 represent division ratios of the first-pass, the second-pass, the third-pass, respectively. Further, when the 2-pass printing is performed, pass division coefficients k1, k2 represent division ratios of the first-pass, the second-pass, respectively.

Further, if components according to the second exemplary embodiment are adopted as a constituent of the print pass number determination unit 480, the effects of the second exemplary embodiment can be also obtained.

In this way, according to these exemplary embodiments, all nozzles can be used for printing also in the transition period during which the pass number is changed. The pass numbers before and after switching are not limited to the ones described in these exemplary embodiments. If they are not less than 2-pass, the effects of the present invention can be obtained.

The aforementioned processing of the exemplary embodiments may be also realized by supplying a storage medium that has recorded a program code of software for implementing each function to a system or apparatus. Then, the aforementioned functions of the exemplary embodiments can be realized by reading out and executing the program code stored in the storage medium by a computer (or a CPU or an MPU) of the system or apparatus. In this case, the program code itself read out from the storage medium implements the functions of the aforementioned exemplary embodiments, so that the storage medium that stores the program code constitutes the present invention. As a storage medium for supplying such a program code, for example, a flexible disk, a hard disk, an optical disc, a magneto-optical disk may be used. Further, a compact disc read-only memory (CD-ROM), a compact disc-recordable (CD-R), a magnetic tape, a non-volatile memory card, a ROM, etc. may be used.

As many apparently widely different embodiments of the present invention can be made without departing from the spirit and scope thereof, it is to be understood that the invention is not Limited to the specific embodiments thereof except as defined in the appended claims.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-107998 filed Apr. 27, 2009, which is hereby incorporated by reference herein in its entirety.

What is claimed is:

1. An image forming apparatus for generating print data for performing image formation by performing using a print head a plurality of reciprocating print scans upon the same printing region on a print medium, the image forming apparatus comprising:

a division unit configured to divide, in units of pixels, image information into a plurality of scans, while controlling division coefficients, the division coefficients being based on a number of times of scans determined for each printing region; and a quantization unit configured to quantize each of the image information divided by the division unit, wherein the number of times of scans differs among at least two printing regions on one recording medium, and wherein the division unit sets, in a printing region of which the number of times of scans differs from the number of times of scans of an adjacent printing region, the division coefficients based on a paper feeding amount and a changing point of the number of times of scans.

2. The image forming apparatus according to claim 1, further comprising:

a conveyance control unit configured to control a conveyance amount of the recording medium based on the division coefficients controlled by the division unit.

3. The image forming apparatus according to claim 2, wherein the division unit, even if the conveyance amount is controlled by the conveyance control unit, controls the division coefficients so that inks are discharged from a plurality of discharge ports in the print head.

4. The image forming apparatus according to claim 1, wherein the division unit changes the number of times of scans, depending on concentration in proximity to a target pixel or its distribution.

5. The image forming apparatus according to claim 1, wherein the division unit controls the division coefficients, based on a position of a printing region currently scanned from a front-end of the print head, a number of times of scans before the change and a number of times of scans after the change.

6. The image forming apparatus according to claim 1, wherein the division unit changes the number of times of scans, in at least one of a leading edge or a trailing edge of the recording medium.

7. The image forming apparatus according to claim 1, wherein the division unit makes a duty to discharge ports applicable to edges of the recording medium smaller than a duty of discharge ports applicable to inner part of the recording medium.

8. The image forming apparatus according to claim 1, wherein the division unit makes a total sum of the pass division coefficients one in scanning the same printing region a number of times.

9. The image forming apparatus according to claim 1, wherein the division unit controls the division coefficients such that a number of idle discharge ports in the print head, which appear by changing the number of times of scans, is reduced.

* * * * *